US009127608B2

(12) United States Patent
Ito et al.

(10) Patent No.: US 9,127,608 B2
(45) Date of Patent: Sep. 8, 2015

(54) CETANE NUMBER ESTIMATION DEVICE

(75) Inventors: Yoshiyasu Ito, Toyota (JP); Takeshi Miyaura, Toyota (JP); Makio Tsuchiyama, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 206 days.

(21) Appl. No.: 13/979,047

(22) PCT Filed: Feb. 8, 2011

(86) PCT No.: PCT/JP2011/052656

§ 371 (c)(1),
(2), (4) Date: Jul. 10, 2013

(87) PCT Pub. No.: WO2012/108005

PCT Pub. Date: Aug. 16, 2012

(65) Prior Publication Data

US 2013/0311063 A1 Nov. 21, 2013

(51) Int. Cl.

| | |
|---|---|
| ***F02D 41/30*** | (2006.01) |
| ***F02D 41/04*** | (2006.01) |
| ***F02D 41/14*** | (2006.01) |
| ***F02D 41/00*** | (2006.01) |
| *F02M 63/00* | (2006.01) |
| *F02M 47/02* | (2006.01) |

(52) U.S. Cl.

CPC ..... *F02D 41/04* (2013.01); *F02D 41/0025* (2013.01); *F02D 41/1497* (2013.01); *F02D 2200/021* (2013.01); *F02D 2200/0406* (2013.01); *F02D 2200/0606* (2013.01); *F02D 2200/0612* (2013.01); *F02D 2200/101* (2013.01); *F02D 2200/1012* (2013.01); *F02M 47/027* (2013.01); *F02M 63/0026* (2013.01); *F02M 2200/95* (2013.01)

(58) Field of Classification Search

CPC ..... F02D 41/04; F02D 41/1497; F02D 2200/0621

USPC ..... 123/1 A, 435; 701/103, 111; 73/35.02, 73/114.38

See application file for complete search history.

(56) References Cited

U.S. PATENT DOCUMENTS

| | | | | |
|---|---|---|---|---|
| 7,480,557 | B2 * | 1/2009 | Yamaguchi et al. | 701/104 |
| 7,673,618 | B2 * | 3/2010 | Hasegawa et al. | 123/435 |
| 7,926,331 | B2 * | 4/2011 | Tsutsumi et al. | 73/114.38 |
| 2007/0204674 | A1 | 9/2007 | Takaku | |
| 2008/0262699 | A1 | 10/2008 | Hasegawa et al. | |
| 2009/0082940 | A1 | 3/2009 | Ishizuka et al. | |
| 2009/0198456 | A1 | 8/2009 | Tsutsumi et al. | |

FOREIGN PATENT DOCUMENTS

| | | |
|---|---|---|
| CN | 101029603 A | 9/2007 |
| JP | A-2008-95675 | 4/2008 |
| JP | A-2008-157160 | 7/2008 |

(Continued)

*Primary Examiner* — Hai Huynh
(74) *Attorney, Agent, or Firm* — Oliff PLC

(57) ABSTRACT

An electronic control unit detects an index value of an amount of generated heat of fuel to be combusted in a diesel engine. The electronic control unit also executes the injection of a predetermined amount of the fuel to estimate a cetane number of the fuel and calculates an index value of output torque of the diesel engine generated with that execution. Then, the electronic control unit calculates an estimated value of the cetane number of the fuel based on the index value of the output torque and the index value of the amount of generated heat.

14 Claims, 12 Drawing Sheets

(56) References Cited

FOREIGN PATENT DOCUMENTS

| | | |
|---|---|---|
| JP | A-2009-74499 | 4/2009 |
| JP | A-2009-180174 | 8/2009 |
| JP | A-2009-281143 | 12/2009 |
| JP | A-2010-144527 | 7/2010 |
| JP | A-2010-270719 | 12/2010 |

* cited by examiner

CETANE NUMBER ESTIMATION DEVICE

TECHNICAL FIELD

The present invention relates to a cetane number estimation device for estimating the cetane number of fuel supplied to a diesel engine.

BACKGROUND ART

In a diesel engine, fuel injected into a combustion chamber by a fuel injector is compressed and ignited after the elapse of a predetermined time (ignition delay) from injection. To improve output performance and emission performance of diesel engines, control devices are widely used that control the engine control mode for the injection timing and the injection amount in fuel injection while taking the ignition delay into account.

In a diesel engine, the lower the cetane number of fuel used, the longer the ignition delay becomes. Thus, even if the engine control execution mode is set before shipment of a diesel engine, supposing that fuel having a standard cetane number will be used, the ignition timing of fuel will be delayed and the state of combustion will be deteriorated if fuel having a relatively low cetane number such as winter fuel is supplied to the fuel tank. Depending on the case, misfiring occurs.

To suppress the occurrence of such inconvenience, it is desirable to correct the engine control execution mode based on the actual cetane number of fuel to be injected into a combustion chamber. To perform such a correction in a favorable manner, it is necessary to correctly estimate the cetane number of fuel.

Conventionally, a device has been proposed in Patent Literature 1 that injects a small amount of fuel from a fuel injector and estimates a cetane number of the fuel based on engine torque generated with fuel injection. In the device disclosed in this Patent Literature 1, the cetane number of the fuel is estimated based on the relationship between the fuel injection amount and the output torque, which have been individually detected, focusing on the fact that the relationship between fuel injection amount and output torque of the diesel engine changes according to the cetane number.

PRIOR ART DOCUMENT

Patent Document

Patent Document 1

Japanese Laid-Open Patent Publication No. 2009-74499

SUMMARY OF THE INVENTION

Problems that the Invention is to Solve

Even if fuels having the same cetane number are combusted by the same amount, the amounts of heat generated at this time are not necessarily the same and the amount of generated heat may vary. This is thought to occur for the following reason. Fuel (light oil) is a mixture mainly containing hydrocarbons, and the hydrocarbons have various structures. Further, various materials are added to the fuel to obtain a constant characteristic. Thus, the density of hydrocarbons in the fuel varies depending on differences in fuel production time and site. The amount of generated heat is thought to vary due to such a density variation.

As long as the amount of heat generated by fuel varies, even if the same amount of fuel is injected and supplied into a diesel engine and combusted, a variation in output torque of this diesel engine is unavoidable. Thus, even if a cetane number of fuel is estimated merely based on the relationship between the fuel injection amount and the output torque as in the device disclosed in Patent Literature 1, it cannot be distinguished whether a change in the output torque is caused by a different cetane number of the fuel or a difference in the amount of generated heat when the output torque changes, wherefore the estimation cannot be accurately performed.

As just described, the device disclosed in Patent Literature 1 cannot avoid reduction in cetane number estimation accuracy due to a variation in the amount of heat generated by fuel, and there is a room for improvement in this respect.

An object of the present invention is to provide a cetane number estimation device capable of accurately estimating a cetane number of fuel.

Means for Solving the Problems

To achieve the foregoing objective, the present invention provides a cetane number estimation device that executes fuel injection by a predetermined injection amount, thereby estimating a cetane number of fuel to be combusted in a diesel engine. The device detects an index value of an amount of heat generated by combustion of the fuel, computes an index value of output torque of the diesel engine that is generated by execution of fuel injection by the predetermined injection amount, and estimates the cetane number based on the index values.

According to the above configuration, the index value of the amount of heat generated by the combustion of the fuel can be detected and the cetane number of the fuel can be estimated based on this index value. Thus, although the output torque of the diesel engine generated with the injection of the predetermined amount of the fuel changes due to a variation of the amount of generated heat of the fuel, the cetane number can be estimated while an effect of that change is considered. Thus, an error in estimating the cetane number of the fuel due to a variation of the amount of generated heat of the fuel is suppressed, and the cetane number of the fuel is accurately estimated.

In accordance with one aspect of the present invention, the device stores in advance a relationship between an estimated value of the cetane number and the index value of the output torque, corrects the relationship based on the index value of the amount of generated heat, and computes the estimated value of the cetane number based on the corrected relationship and the index value of the output torque.

In accordance with one aspect of the present invention, the device stores in advance a relationship between an estimated value of the cetane number and the index value of the output torque, corrects the index value of the output torque based on the index value of the amount of generated heat, and computes the estimated value of the cetane number based on the corrected index value and the relationship.

In accordance with one aspect of the present invention, the device executes fuel injection for estimating the cetane number based on an injection amount that has been corrected in accordance with the index value of the amount of generated heat, and estimates the cetane number based on the index value of the output torque that has been computed at the execution of the fuel injection.

In accordance with a preferable aspect, the device executes fuel injection by a predetermined injection amount to detect the amount of generated heat of the fuel, computes the index value of output torque of the diesel engine that is generated by execution of the fuel injection, and sets the computed index value as the index value of the amount of generated heat.

The device preferably executes, based on a target injection amount, fuel injection for detecting the amount of generated heat. The device further includes a pressure sensor that detects a fuel pressure that is an index of fuel pressure inside a fuel injector. The device corrects the target injection amount based on a fluctuating waveform of fuel pressure detected by the pressure sensor at fuel injection.

The device preferably computes an actual operating characteristic of the fuel injector based on the fluctuating waveform of the detected fuel pressure, and corrects the target injection amount based on a difference between the computed actual operating characteristic and a predetermined basic operating characteristic.

In accordance with one aspect of the present invention, the device detects a temperature of the fuel using a temperature sensor, and corrects the target injection amount based on the detected fuel temperature.

In accordance with a preferable aspect, the device performs the detection of the fuel temperature using the temperature sensor immediately before the execution of the fuel injection for detecting the amount of generated heat.

In accordance with one aspect of the present invention, the device executes, based on a target fuel injection amount, fuel injection for estimating the cetane number. The device further includes a pressure sensor that detects a fuel pressure that is an index of fuel pressure inside a fuel injector. The device corrects the target fuel injection amount based on a fluctuating waveform of fuel pressure detected by the pressure sensor at fuel injection.

In accordance with a preferable aspect, the device computes an actual operating characteristic of the fuel injector based on the fluctuating waveform of the detected fuel pressure, and corrects the target fuel injection amount based on a difference between the computed actual operating characteristic and a predetermined basic operating characteristic.

In accordance with one aspect of the present invention, the device executes, based on a target fuel injection amount, fuel injection for estimating the cetane number, detects a temperature of the fuel using a temperature sensor, and corrects the target fuel injection amount based on the detected fuel temperature.

The device preferably performs the detection of the fuel temperature using the temperature sensor immediately before the execution of the fuel injection for estimating the cetane number.

The pressure sensor is preferably attached to the fuel injector.

MODES FOR CARRYING OUT THE INVENTION

Hereinafter, a cetane number estimation device according to one embodiment of the present invention will be described.

Figure 1:
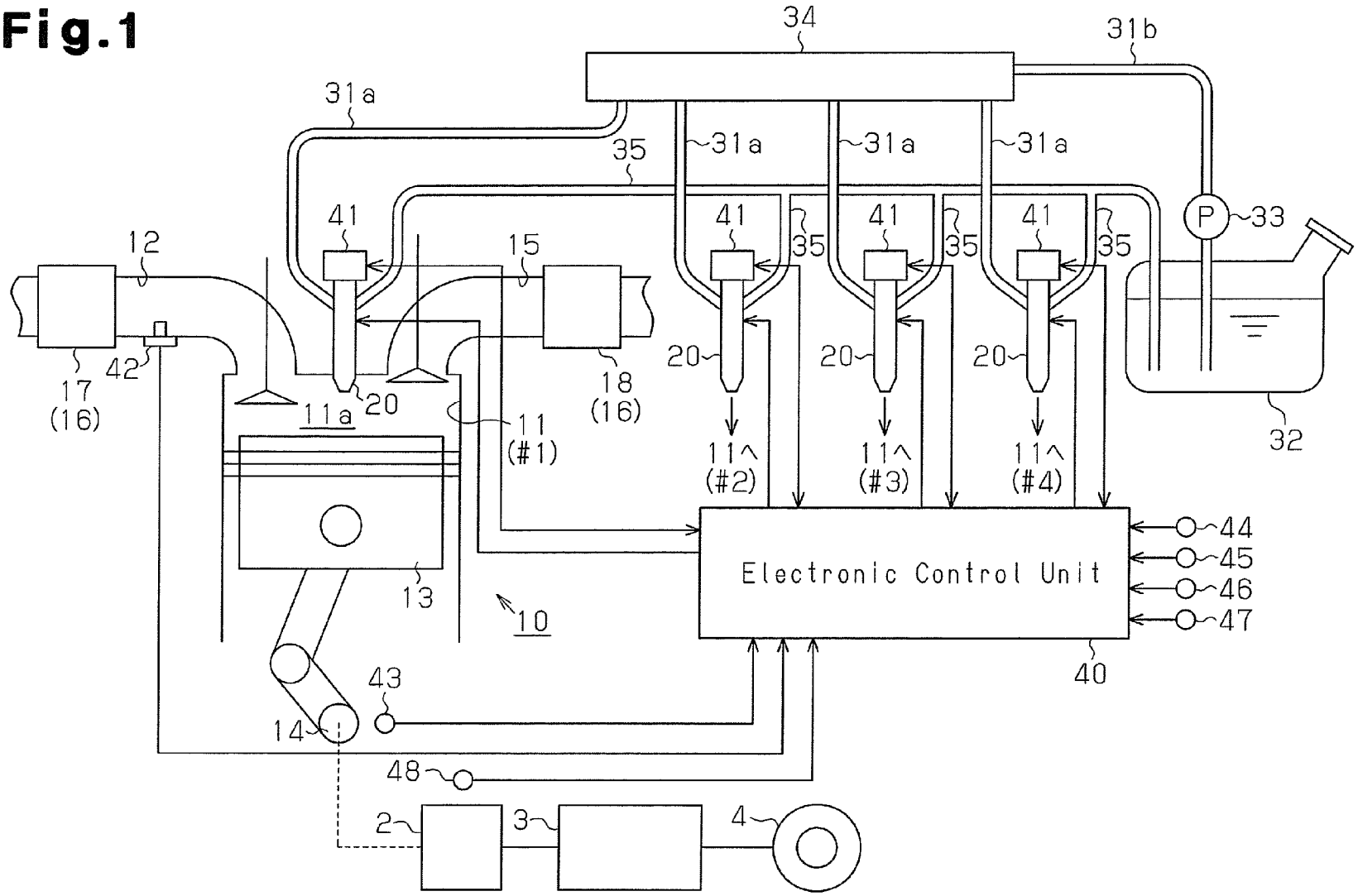
FIG. 1 is a diagram showing a schematic configuration of a cetane number estimation device according to one embodiment of the present invention.

As shown in FIG. 1, a diesel engine 10 is installed as a drive source in a vehicle 1. A crankshaft 14 of the diesel engine 10 is coupled to wheels 4 via a clutch mechanism 2 and a manual transmission 3. When a clutch operating member (e.g. clutch pedal) is operated by a driver in the vehicle 1, the clutch mechanism 2 is set in an operating condition to disconnect the crankshaft 14 from the manual transmission 3.

An intake passage 12 is connected to cylinders 11 of the diesel engine 10. Air is taken into the cylinders 11 of the diesel engine 10 via the intake passage 12. Further, a diesel engine with a plurality of cylinders 11 (four denoted #1 to #4 in the present embodiment) is adopted as the diesel engine 10. In the diesel engine 10, a direct injection type fuel injector 20 for directly injecting fuel into the cylinder 11 is mounted in each cylinder 11. The fuel injected by opening the fuel injector 20 comes into contact with intake air compressed and heated in the cylinder 11 of the diesel engine 10, thereby being ignited and combusted. In the diesel engine 10, a piston 13 is pushed down by energy produced by the combustion of the fuel in the cylinder 11 and the crankshaft 14 is forcibly rotated. Burned gas produced by combustion in the cylinders 11 of the diesel engine 10 is discharged as exhaust gas to an exhaust passage 15 of the diesel engine 10.

An exhaust driven type supercharger 16 is provided in the diesel engine 10. The supercharger 16 includes a compressor 17 mounted in the intake passage 12 of the diesel engine 10 and a turbine 18 mounted in the exhaust passage 15. The supercharger 16 feeds the intake air passing the intake passage 12 under pressure utilizing energy of the exhaust gas passing the exhaust passage 15 of the diesel engine 10.

Each fuel injector 20 is individually connected to a common rail 34 via a branch passage 31*a*, and this common rail 34 is connected to a fuel tank 32 via a supply passage 31*b*. A fuel pump 33 for feeding fuel under pressure is provided in this supply passage 31*b*. In the present embodiment, the fuel whose pressure is increased by being fed under pressure by the fuel pump 33 is stored in the common rail 34 and supplied into each fuel injector 20. Further, a return passage 35 is connected to each fuel injector 20, and these return passages 35 are respectively connected to the fuel tank 32. Some of the fuel inside the fuel injector 20 is returned to the fuel tank 32 via this return passage 35.

The internal structure of each fuel injector 20 will be described below.

Figure 2:
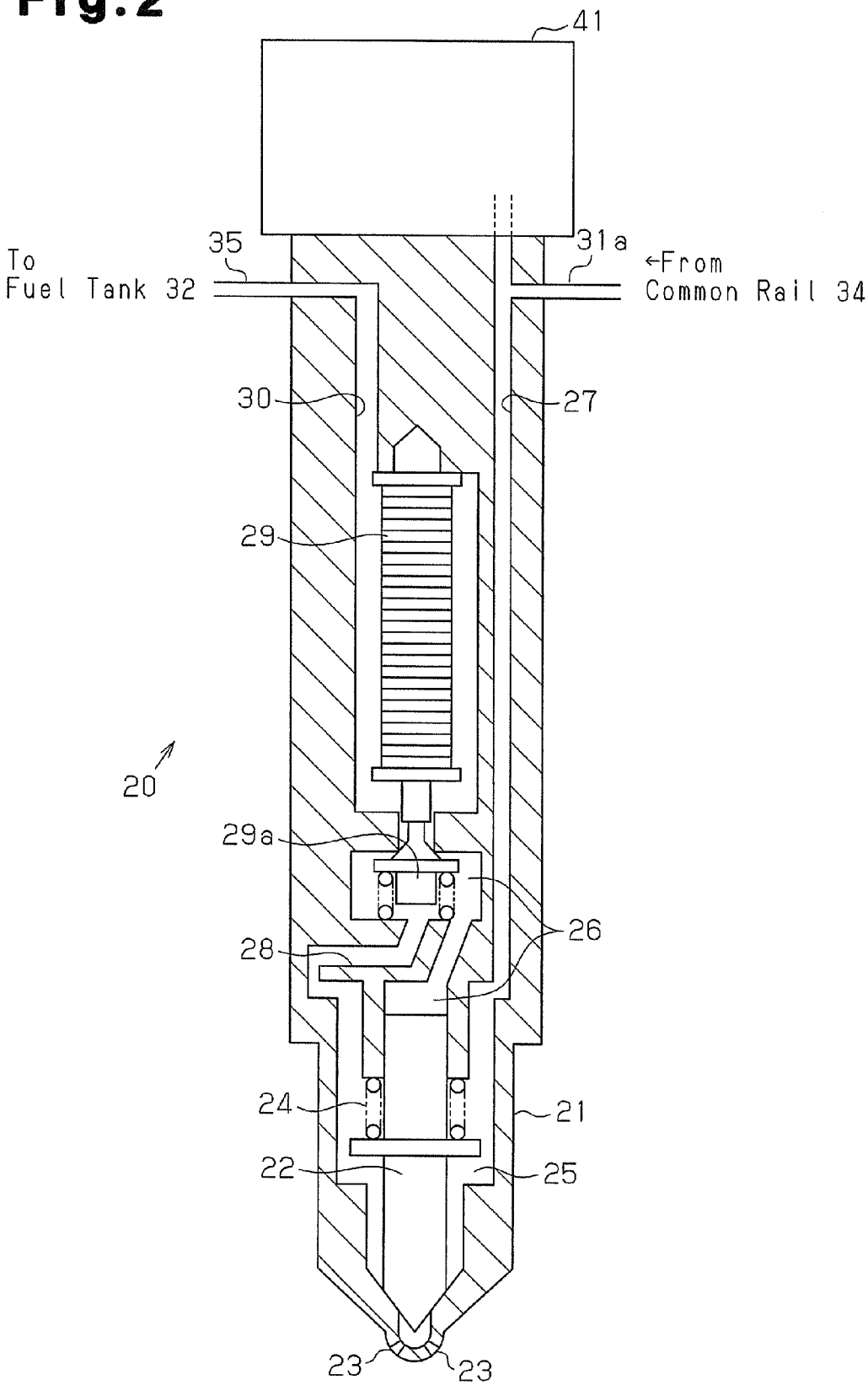
FIG. 2 is a cross-sectional view showing a cross-sectional structure of a fuel injector.

As shown in FIG. 2, a needle valve 22 is provided inside a housing 21 of the fuel injector 20. This needle valve 22 is provided in a state to be reciprocally movable (vertically movable in FIG. 2) in the housing 21. A spring 24 for constantly urging the above needle valve 22 toward an injection hole 23 (downward in FIG. 2) is provided inside the housing 21. Further, inside the housing 21, a nozzle chamber 25 is formed at a position at one side (lower side in FIG. 2) of the above needle valve 22 and a pressure chamber 26 is formed at a position at the other side (upper side in FIG. 2).

The nozzle chamber 25 is formed with the injection hole 23 allowing communication of the interior of the nozzle chamber 25 and the outside of the housing 21, and the fuel is supplied from the above branch passage 31*a* (common rail 34) via an introducing passage 27. The above nozzle chamber 25 and branch passage 31*a* (common rail 34) are connected to the pressure chamber 26 via a communication passage 28. Further, the pressure chamber 26 is connected to the return passage 35 (fuel tank 32) via a discharge passage 30.

The above fuel injector 20 is of an electrically driven type. A piezoelectric actuator 29 formed by laminating piezoelectric elements that extend and contract by the input of a drive signal is provided inside the housing 21 of the fuel injector 20. A valve body 29*a* is attached to this piezoelectric actuator 29 and provided inside the pressure chamber 26. One of the communication passage 28 (nozzle chamber 25) and the discharge passage 30 (return passage 35) is selectively allowed to communicate with the pressure chamber 26 through movement of the valve body 29*a* caused by the operation of the piezoelectric actuator 29.

In this fuel injector 20, when a valve closing signal is input to the piezoelectric actuator 29, the piezoelectric actuator 29 contracts to move the valve body 29*a*, thereby setting a state where the communication passage 28 and the pressure chamber 26 are allowed to communicate and a state where communication between the return passage 35 and the pressure chamber 26 is blocked. In this way, the nozzle chamber 25 and the pressure chamber 26 are allowed to communicate with the discharge of the fuel in the pressure chamber 26 to the return passage 35 (fuel tank 32) inhibited. Thus, the pressure difference between the nozzle chamber 25 and the pressure chamber 26 becomes very small and the needle valve 22 is moved to a position to close the injection hole 23 by the urging force of the spring 24. At this time, the fuel injector 20 is set in a state where the fuel is not injected (valve closed state).

On the other hand, when a valve opening signal is input to the piezoelectric actuator 29, the piezoelectric actuator 29 extends to move the valve body 29*a*, thereby setting a state where communication between the communication passage 28 and the pressure chamber 26 is blocked and a state where the return passage 35 and the pressure chamber 26 are allowed to communicate. In this way, some of the fuel in the pressure chamber 26 is returned to the fuel tank 32 via the return passage 35 with the discharge of the fuel from the nozzle chamber 25 to the pressure chamber 26 inhibited. Thus, a pressure of the fuel in the pressure chamber 26 decreases to increase the pressure difference between the pressure chamber 26 and the nozzle chamber 25 and the needle valve 22 is moved away from the injection hole 23 against the urging force of the spring 24 due to this pressure difference. At this time, the fuel injector 20 is set in a state where the fuel is injected (valve open state).

A fuel sensor 41 for outputting a signal corresponding to a fuel pressure PQ inside the introducing passage 27 is integrally attached to the fuel injector 20. Thus, as compared with a device in which a fuel pressure at a position distant from the fuel injector 20 such as a fuel pressure in the common rail 34 (see FIG. 1) is detected, a fuel pressure at a position close to the injection hole 23 of the fuel injector 20 can be detected. Changes in the fuel pressure inside the fuel injector 20 associated with the opening of the fuel injector 20 thus can be accurately detected. A fuel sensor that also functions as a temperature sensor for detecting a fuel temperature (THQ) inside the introducing passage 27 in addition to a function as a pressure sensor is used as this fuel sensor 41. The functions of the fuel sensor 41 are switched in accordance with a signal input from an electronic control unit 40, which will be discussed below. Further, one fuel sensor 41 is provided for each fuel injector 20, i.e. for each cylinder 11 of the diesel engine 10.

As shown in FIG. 1, the diesel engine 10 includes various sensors for detecting operating state as peripheral devices. In addition to the above fuel sensor 41, these sensors include, for example, a supercharging pressure sensor 42 for detecting a pressure (supercharging pressure PA) in a part of the intake passage 12 downstream of the above compressor 17 in an intake flowing direction and a crank sensor 43 for detecting a rotational phase (crank angle CA) and a rotation speed of the crankshaft 14 (engine speed NE). These sensors further include a water temperature sensor 44 for detecting a temperature of coolant (THW) of the diesel engine 10, a reserve amount sensor 45 for detecting a reserve amount of the fuel in the fuel tank 32 and an accelerator operation amount sensor 46 for detecting an operation amount (accelerator operation amount ACC) of an accelerator operating member (e.g. accelerator pedal). In addition to these, a vehicle speed sensor 47 for detecting a running speed of the vehicle 1, a clutch switch 48 for detecting whether or not the clutch operating member has been operated, and the like are also provided.

The electronic control unit 40 including a microcomputer and the like is, for example, also provided as a peripheral device of the diesel engine 10. The electronic control unit 40 functions as an estimation unit for estimating a cetane number of fuel, receives output signals of various sensors, performs various computations based on these output signals, and executes various controls relating to the operation of the diesel engine 10 such as an operation control of the fuel injectors 20 (fuel injection control) based on the computation results.

The fuel injection control of the present embodiment is basically executed as follows.

First, a control target value (required injection amount TAU) relating to a fuel injection amount for engine operation is calculated based on the accelerator operation amount ACC, the engine speed NE and a cetane number of the fuel (specifically, estimated cetane number, which will be discussed below). Thereafter, a control target value of the fuel injection timing (required injection timing Tst) and a control target value of a fuel injection time (required injection time Ttm) are calculated based on the required injection amount TAU and the engine speed NE. Then, each fuel injector 20 is opened based on these required injection timing Tst and required injection time Ttm. In this way, an amount of fuel matching the operating state of the diesel engine 10 at each successive point in time is injected from each fuel injector 20 and supplied into the corresponding cylinder 11 of the diesel engine 10.

Further, in the present embodiment, an operation control (rail pressure control) of the fuel pump 33 is executed in association with the execution of such a fuel injection control. This rail pressure control is executed to adjust a fuel pressure (rail pressure) in the common rail 34 in accordance with the operating state of the diesel engine 10. Specifically, a control target value (required rail pressure Tpr) relating to the rail pressure is calculated based on the required injection amount TAU and the engine speed NE. Then, the operation of the fuel pump 33 is so controlled that this required rail pressure Tpr and the actual rail pressure match, whereby a fuel pressure feed amount of the fuel pump 33 is adjusted.

Furthermore, in the present embodiment, in order to properly execute fuel injection in accordance with the operating state of the diesel engine 10, a correction process for forming a detection temporal waveform of a fuel injection rate based on the fuel pressure PQ detected by the fuel sensor 41 and correcting the required injection timing Tst and the required injection time Ttm based on the detection temporal waveform is executed. This correction process is separately executed for each cylinder 11 of the diesel engine 10. Such a correction process will be described in detail below.

The fuel pressure inside the fuel injector 20 varies as the fuel injector 20 is opened and closed such as a decrease with the opening of the fuel injector 20 and an increase with the subsequent closing of this fuel injector 20. Thus, the actual operation characteristic (e.g. timing at which a valve opening action is started, timing at which a valve closing action is started) of the fuel injector 20 can be accurately grasped by monitoring a fluctuating waveform of the fuel pressure at the execution of the fuel injection.

A procedure of forming such a fluctuating waveform (in the present embodiment, detection temporal waveform of the fuel injection rate) of the fuel pressure at the execution of the fuel injection will first be described.

Figure 3:
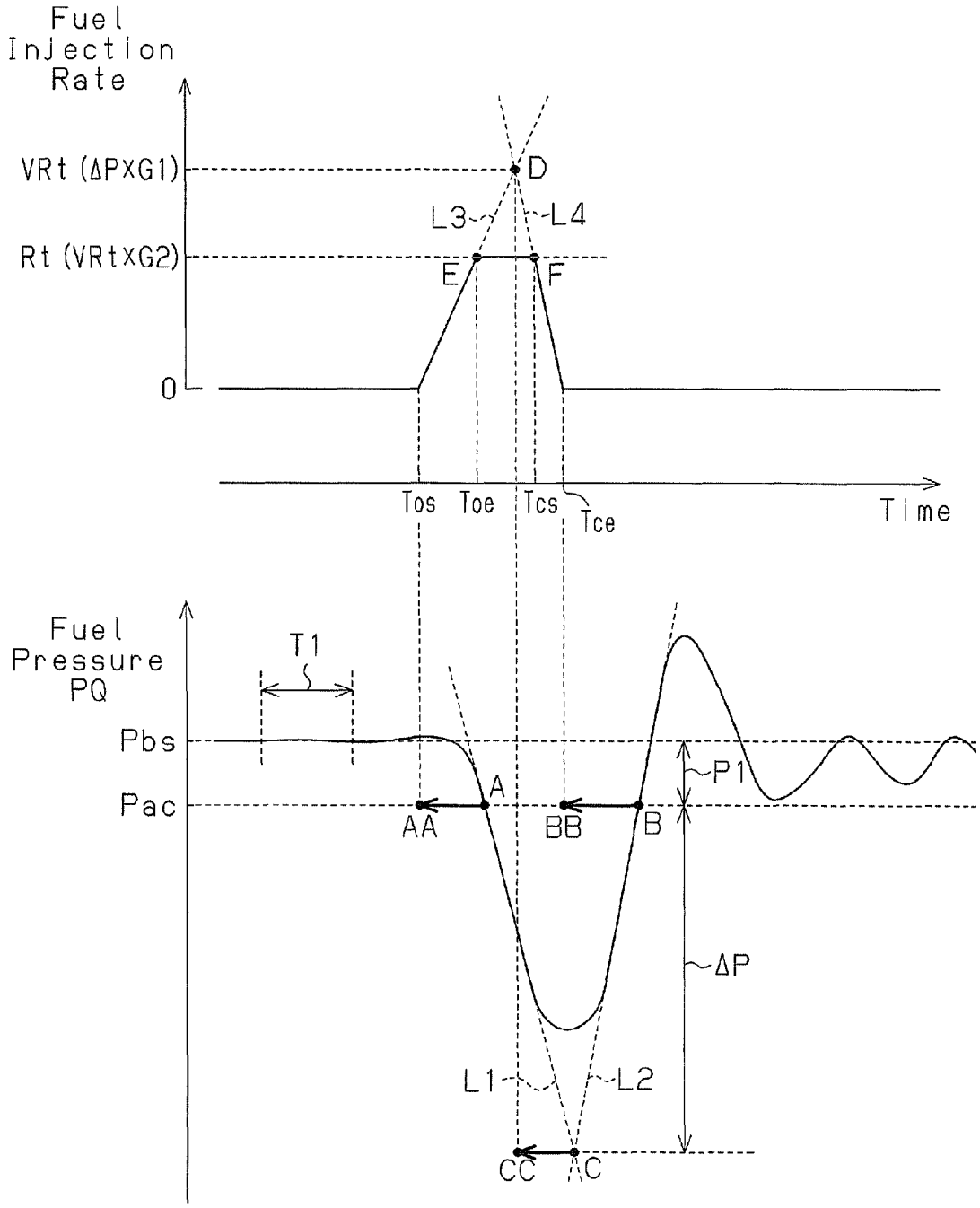
FIG. 3 is a time chart showing a relationship between changes of fuel pressure and detection temporal waveform of a fuel injection rate.

FIG. 3 shows a relationship between changes of the fuel pressure PQ and the detection temporal waveform of the fuel injection rate.

As shown in FIG. 3, timing at which the valve opening action of the fuel injector 20 (specifically, a movement of the needle valve 22 toward a valve opening side) is started (valve opening action start timing Tos), timing at which the fuel injection rate is maximized (injection rate maximization timing Toe), timing at which drop of the fuel injection rate starts (injection rate drop start timing Tcs) and timing at which the valve closing action (specifically, the movement of the needle valve 22 toward a valve closing side) of the fuel injector 20 is completed (valve closing action completion timing Tce) are respectively detected in the present embodiment.

First, an average value of the fuel pressure PQ during a predetermined period T1 immediately before the valve opening action of the fuel injector 20 is started is calculated and stored as a reference pressure Pbs. This reference pressure Pbs is used as a pressure equivalent to a fuel pressure inside each fuel injector 20 at the time of valve closing.

Subsequently, the value obtained by subtracting a predetermined pressure P1 from this reference pressure Pbs is calculated as an operating pressure Pac (Pac=Pbse−P1). This predetermined pressure P1 is a pressure equivalent to a change of the fuel pressure PQ despite the needle valve 22 being located at a valve closing position in driving the fuel injector 20 open or closed, i.e. a change of the fuel pressure PQ not contributing to a movement of the needle valve 22.

Thereafter, a first-order differential value of the fuel pressure PQ in a period during which the fuel pressure PQ drops immediately after the start of the execution of the fuel injection is calculated. Then, a tangential line L1 of a temporal waveform of the fuel pressure PQ at a point where this first-order differential value is minimized is obtained and an intersection point A of this tangential line L1 and the operating pressure Pac is calculated. Timing corresponding to a point AA, to which the intersection point A is brought back in time by a detection delay of the fuel pressure PQ is identified as the valve opening action start timing Tos. The above detection delay is a period equivalent to a delay in a change timing of the fuel pressure PQ in response to a change timing of the pressure in the nozzle chamber 25 (see FIG. 2) of the fuel injector 20 and is a delay caused due to the distance between the nozzle chamber 25 and the fuel sensor 41 and the like.

Further, a first-order differential value of the fuel pressure PQ in a period during which the fuel pressure PQ increases after temporarily dropping immediately after the start of the execution of the fuel injection is calculated. Then, a tangential line L2 of the temporal waveform of the fuel pressure PQ at a point where this first-order differential value is maximized is obtained and an intersection point B of this tangential line L2 and the operating pressure Pac is calculated. Timing corresponding to a point BB, to which the intersection point B is brought back in time by the detection delay, is identified as the valve closing action start timing Tce.

Furthermore, an intersection point C of the tangential lines L1, L2 is calculated and the difference between the fuel pressure PQ and the operating pressure Pac (hypothetical pressure drop ΔP [ΔP=Pac−PQ]), at this intersection point C is obtained. Further, the value obtained by multiplying this hypothetical pressure drop AP by a gain G1, which is set based on the required injection amount TAU and the required rail pressure Tpr, is calculated as a hypothetical maximum fuel injection rate VRt (VRt=ΔP×G1). Furthermore, the value obtained by multiplying the hypothetical maximum fuel injection rate VRt by a gain G2, which is set based on the required injection amount TAU and the required rail pressure Tpr, is calculated as a maximum injection rate Rt (Rt=VRt×G2).

Thereafter, timing CC reached by bringing back the above intersection point C in time by the detection delay is calculated and a point D, at which the hypothetical maximum fuel injection rate VRt is reached at the timing CC, is identified. Then, timing corresponding to an intersection point E of a straight line L3 connecting the point D and the valve opening action start timing Tos (specifically, point at which the fuel injection rate becomes "0" at this timing Tos) and the maximum injection rate Rt is identified as the injection rate maximization timing Toe.

Further, timing corresponding to an intersection point F of a straight line L4 connecting the above point D and the valve closing action completion timing Tce (specifically, point at which the fuel injection rate becomes "0" at this timing Tce) and the maximum injection rate Rt is identified as the injection rate drop start timing Tcs.

Furthermore, a trapezoidal temporal waveform formed by the valve opening action start timing Tos, the injection rate maximization timing Toe, the injection rate drop start timing Tcs, the valve closing action completion timing Tce and the maximum injection rate Rt is used as a detection temporal waveform for the fuel injection rate in the fuel injection.

Figure 4:
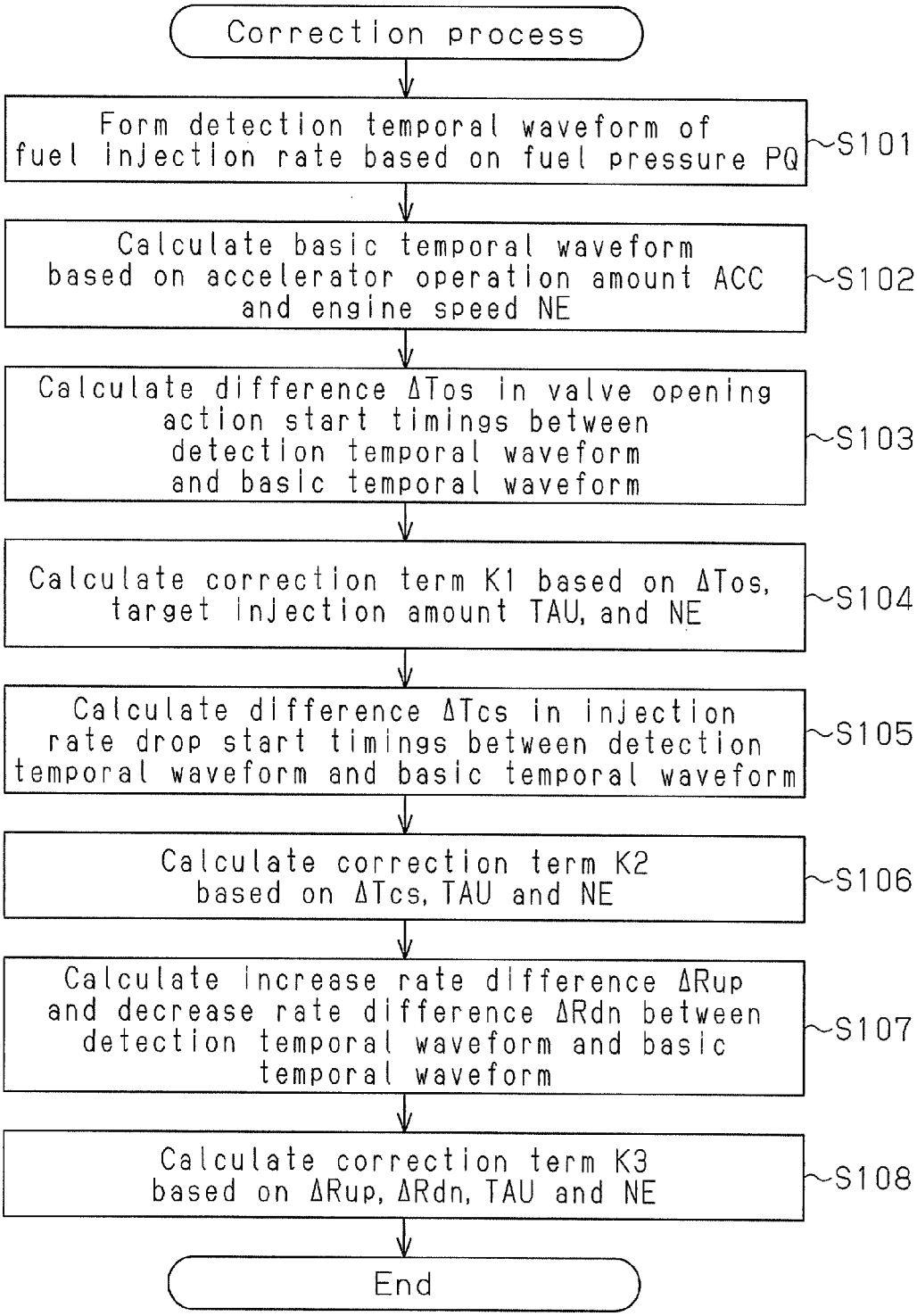
FIG. 4 is a flowchart showing an execution procedure of a correction process.
Figure 5:
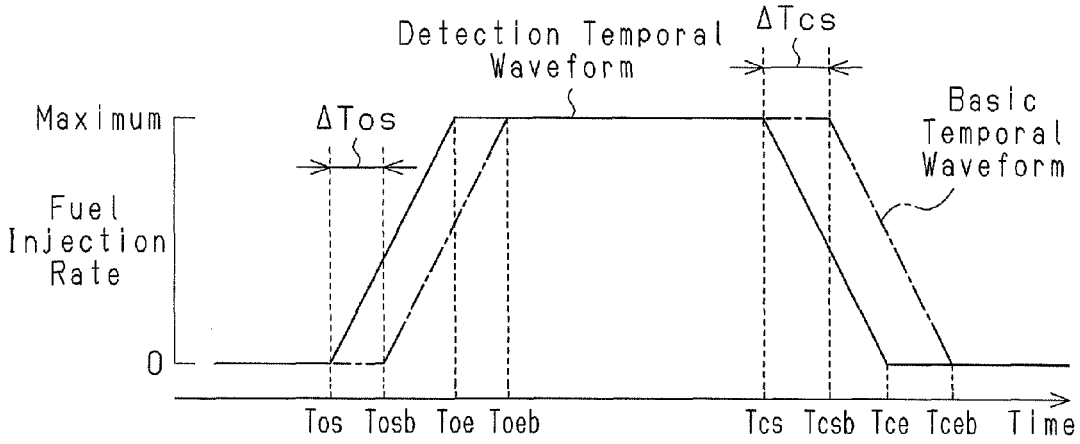
FIG. 5 is a time chart showing an example of a relationship between the detection temporal waveform and a basic temporal waveform.
Figure 6:
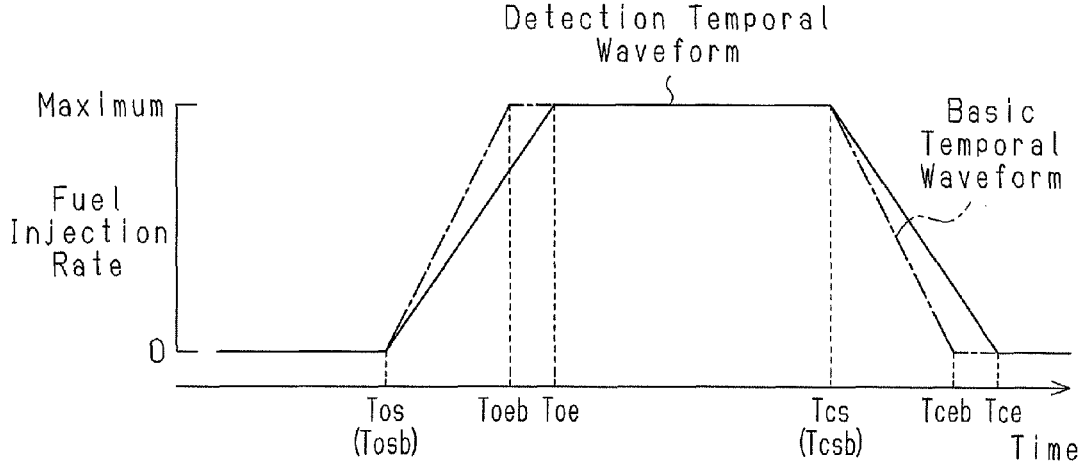
FIG. 6 is a time chart showing an example of a relationship between the detection temporal waveform and the basic temporal waveform.

Next, with reference to FIGS. 4 to 6, a procedure of a process for correcting various control target values of the fuel injection control based on such a detection temporal waveform (correction process) is described in detail.

FIG. 4 is a flowchart showing a specific procedure of the above correction process and a series of processings shown in this flowchart are performed as interrupt processings in each predetermined cycle by the electronic control unit 40. Further, FIGS. 5 and 6 respectively show examples of a relationship between the detection temporal waveform and a basic temporal waveform.

As shown in FIG. 4, in this process, the detection temporal waveform in the fuel injection is first formed based on the fuel pressure PQ as described above (step S101). Further, a basic value (basic temporal waveform) for the temporal waveform of the fuel injection rate in the fuel injection is set based on the operating state of the diesel engine 10 such as the accelerator operation amount ACC and the engine speed NE (step S102). In the present embodiment, a relationship between the operating state of the diesel engine 10 and the basic temporal waveform suitable for the operating state is obtained in advance based on results of experimentation or simulation and stored in the electronic control unit 40. In step S102, the basic temporal waveform is set from the above relationship based on the operating state of the diesel engine 10 at each successive point in time. In the present embodiment, the above detection temporal waveform functions as the actual operation characteristic of the fuel injector 20 and the basic temporal waveform functions as a predetermined basic operation characteristic.

As shown in FIG. 5, a trapezoidal temporal waveform is defined by a valve opening action start timing Tosb, a injection rate maximization timing Toeb, an injection rate drop start timing Tcsb, a valve closing action completion timing Tceb and a maximum injection rate is set as the above basic temporal waveform (line formed by a long dash alternating with a short dash).

Then, such a basic temporal waveform and the above detection temporal waveform (solid line) are compared and a correction term K1 for correcting a control target value for the start timing of the fuel injection (required injection timing Tst described above) and correction terms K2, K3 for correcting a control target value for the execution time of the fuel injection (required injection time Ttm) are respectively calculated based on the comparison result.

Specifically, the difference ΔTos between the valve opening action start timing Tosb in the basic temporal waveform and the valve opening action start timing Tos in the detection temporal waveform is calculated (step S103 of FIG. 4), and the correction term K1 is calculated and stored based on this difference ΔTos, the required injection amount TAU, and the engine speed NE (step S104). In the present embodiment, a relationship between i) a situation determined by the above difference ΔTos, the required injection amount TAU and the engine speed NE and ii) the correction term K1 capable of precisely compensating for this difference ΔTos is obtained in advance based on results of experimentation and simulation and stored in the electronic control unit 40. In step S104, the correction term K1 is calculated based on this relationship.

Further, the difference ΔTcs between the injection rate drop start timing Tcsb (FIG. 5) in the basic temporal waveform and the injection rate drop start timing Tcs in the detection temporal waveform is calculated (step S105 of FIG. 4) and the correction term K2 is calculated and stored based on this difference ΔTcs, the required injection amount TAU and the engine speed NE (step S106). In the present embodiment, a relationship between i) a situation determined by the above difference ΔTcs, the required injection amount TAU and the engine speed NE and ii) the correction term K2 capable of precisely compensating for this difference ΔTcs is obtained in advance based on results of experimentation and simulation and stored in the electronic control unit 40. In the processing of step S106, the correction term K2 is calculated based on this relationship.

As shown in FIG. 6, in calculating the correction term K3, the difference in change rate of the fuel injection rate between the basic temporal waveform (line formed by a long dash alternating with a short dash) and the detection temporal waveform (solid line) is first calculated (step S107). Specifically, the difference ΔRup in the inclination of a line segment connecting the valve opening action start timing Tos (or Tosb) and the injection rate maximization timing Toe (or Toeb) is calculated as an increase rate difference of the fuel injection rate. Further, the difference ΔRdn in the inclination of a line segment connecting the injection rate drop start timing Tcs (or Tcsb) and the valve closing action completion timing Tce (or Tcsb) is calculated as a drop rate difference of the fuel injection rate. In the present embodiment, these differences ΔRup, ΔRdn are calculated as values highly correlated to the area difference between the basic temporal waveform and the detection temporal waveform. Then, the correction term K3 is calculated and stored based on these differences ΔRup, ΔRdn, the required injection amount TAU and the engine speed NE (step S108). In the preset embodiment, a relationship between i) a situation determined by the respective differences ΔRup, ΔRdn, the required injection amount TAU and the engine speed NE and ii) the correction term K3 capable of precisely compensating for the difference in the area (specifically, partial area of each waveform enclosed by the fuel injection rate and a line along which the fuel injection rate is "0") between the basic temporal waveform and the detection temporal waveform is obtained in advance based on results of an experimentation and simulation and stored in the electronic control unit 40. In step S108, the correction term K3 is calculated based on this relationship.

After the respective correction terms K1, K2 and K3 are calculated in this way, this process is temporarily suspended.

In executing the fuel injection control, the value obtained by correcting the required injection timing Tst using the correction term K1 (in the present embodiment, the value obtained by adding the correction term Ni to the required injection timing Tst) is calculated as a final required injection timing Tst. By calculating the required injection timing Tst in this way, the deviation between the valve opening action start timing Tosb in the basic temporal waveform and the valve opening action start timing Tosb in the detection temporal waveform is suppressed. Thus, the fuel injection start timing is accurately set in accordance with the operating state of the diesel engine 10.

Further, the value obtained by correcting the required injection time Ttm using the above correction terms K2, K3 (in the present embodiment, the value obtained by adding the correction terms K2, K3 to the required injection time Ttm) is calculated as a final required injection time Ttm. By calculating the required injection time Ttm in this way, the deviation between the injection rate drop start timing Tcsb in the basic temporal waveform and the injection rate drop start timing Tcs in the detection temporal waveform is suppressed. Thus, timing at which the fuel injection rate starts decreasing in the fuel injection is accurately set in accordance with the operating state of the diesel engine 10.

Since the required injection timing Tst and the required injection time Ttm are corrected based on the difference between the actual operation characteristic (specifically, detection temporal waveform) of the fuel injector 20 and the predetermined basic operation characteristic (specifically, basic temporal waveform) in the present embodiment, the deviation between the actual operation characteristic of the fuel injector 20 and the basic operation characteristic (operation characteristic of a fuel injector having a standard characteristic) is suppressed. In this way, the execution timing and the execution time of the fuel injection are respectively properly set to match the operating state of the diesel engine 10.

Even if both the valve opening action start timing and the injection rate drop start timing match between the basic temporal waveform and the detection temporal waveform, there is a possibility that the area of the basic temporal waveform and that of the detection temporal waveform do not match and the fuel injection amount deviates from the amount matching the operating state of the diesel engine if the increase rate and the drop rate of the fuel injection rate differ between the basic temporal waveform and the detection temporal waveform. In this respect, in the present embodiment, the area difference between the basic temporal waveform and the detection temporal waveform is suppressed by the correction using the above correction term K3. Thus, the fuel injection amount in the fuel injection is accurately adjusted to an amount matching the operating state of the diesel engine 10.

Further, since the above rail pressure control is executed in the device of the present embodiment, the amount of change in the valve opening action start timing when the required injection timing Tst is changed by the same value and the amount of change in the injection rate drop start timing when the required injection time Ttm is changed by the same value differ according to the rail pressure. In the present embodiment, the above rail pressure (specifically, required injection amount TAU and engine speed NE as calculation parameters of the required rail pressure Tpr) is used as a calculation parameter used for the calculation of the respective correction terms K1, K2 and K3. Thus, the respective correction terms K1, K2 and K3 are properly calculated in accordance with the rail pressure at each successive point in time.

In the device according to the present embodiment, control for estimating the cetane number of fuel (estimation control) is executed.

This estimation control is basically executed as follows. Specifically, a predetermined amount (e.g. several cubic millimeters) of fuel is injected when an execution condition holds and an index value (engine speed fluctuation amount ΣΔNE, which will be discussed below) of output torque of the diesel engine 10 generated with the execution of that fuel injection is calculated. Then, the cetane number of the fuel is estimated based on this engine speed fluctuation amount ΣΔNE. The higher the cetane number of the fuel supplied to the diesel engine 10, the more easily the fuel is ignited and the less fuel is left uncombusted. Thus, the engine torque generated with the combustion of the fuel increases. In the estimation control of the present embodiment, the cetane number of the fuel is estimated based on such a relationship between the cetane number of the fuel and the output torque of the diesel engine 10.

Output torque of the diesel engine 10 generated when a predetermined amount of fuel is injected changes according to the engine speed NE in addition to changing according to the cetane number of the fuel. This is for the following reason.

Figure 7:
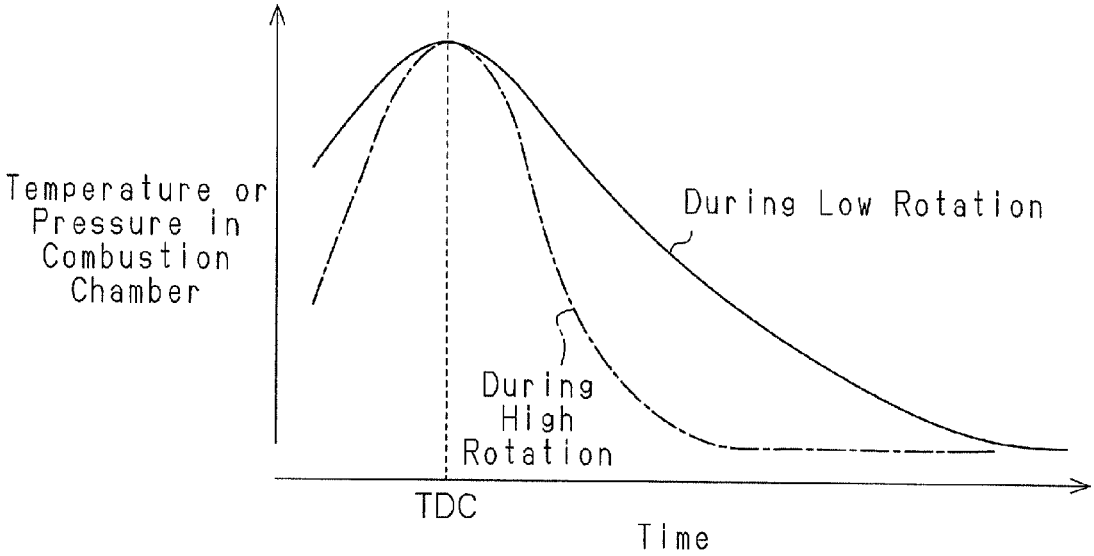
FIG. 7 is a time chart showing an example of a relationship between temperature in a combustion chamber and an engine speed.

FIG. 7 shows an example of a relationship between the temperature (or pressure) in a combustion chamber 11*a* of the diesel engine 10 and the engine speed NE. As shown in FIG. 7, the higher the engine speed NE, the shorter the period during which a high-temperature, high-pressure condition is set in the combustion chamber 11*a* becomes. Thus, when the predetermined amount of fuel is injected in the above estimation control, the higher the engine speed NE, the earlier the temperature and the pressure in the combustion chamber 11*a* become lower and the more likely the fuel is left uncombusted. Therefore, the output torque of the diesel engine 10 generated with that fuel injection tends to become smaller.

Figure 8:
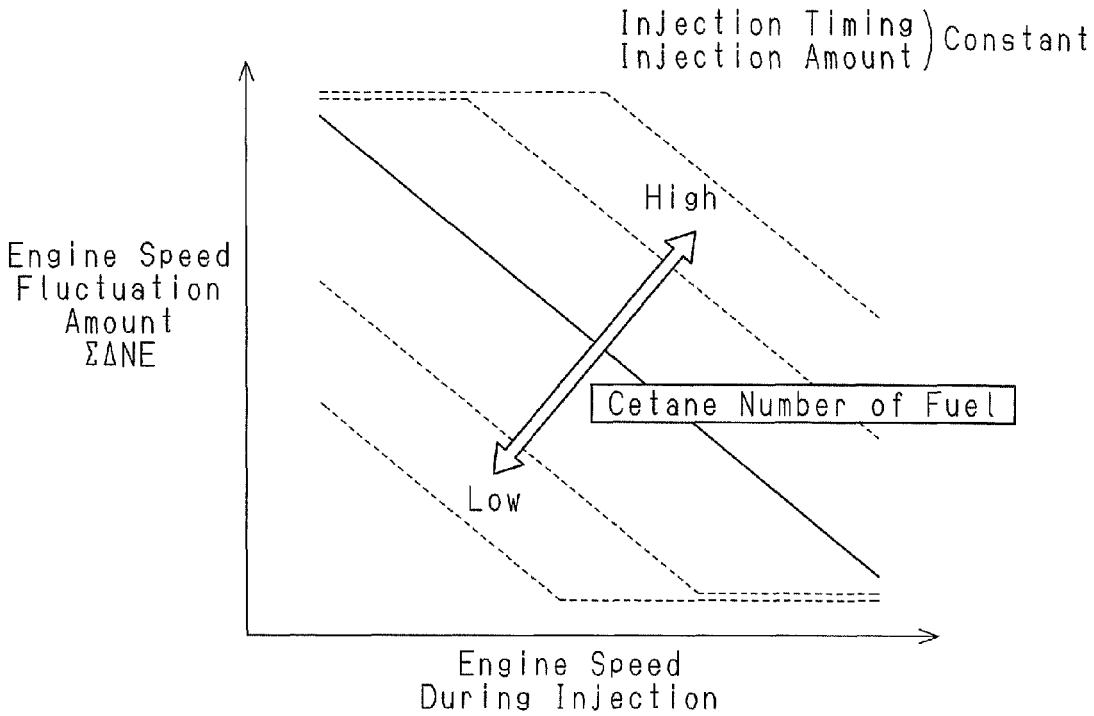
FIG. 8 is a graph showing a relationship of an engine speed fluctuation amount, an engine speed during injection and a cetane number of fuel.

FIG. 8 shows a relationship between the engine speed fluctuation amount ΣΔNE and the engine speed NE when the same amount of fuel is injected at the same injection timing. As is clear from FIG. 8, when the same amount of fuel is injected at the same injection timing, the higher the engine speed NE at the execution of the fuel injection (hereinafter, engine speed during injection), the smaller the output torque of the diesel engine 10 (specifically, engine speed fluctuation amount ΣΔNE as an index value thereof) becomes.

Further, the output torque of the diesel engine 10 generated when the predetermined amount of fuel is injected changes according to the execution time of this fuel injection in addition to changing according to the cetane number of the fuel and the engine speed NE.

Figure 9:
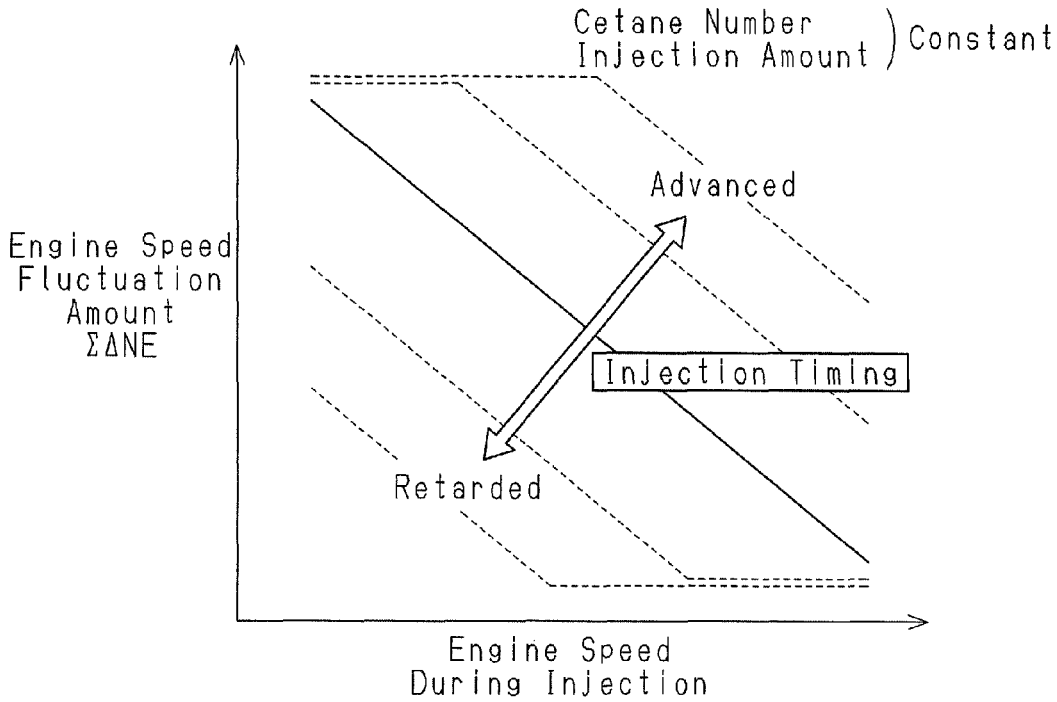
FIG. 9 is a graph showing a relationship of the engine speed fluctuation amount, the engine speed during injection, and an execution timing of fuel injection.

FIG. 9 shows a relationship of the engine speed fluctuation amount ΣΔNE, the engine speed during injection and the execution timing of the fuel injection when the same amount of fuel having the same cetane number is injected. As shown in FIG. 9, the more retarded the execution timing of the fuel injection, the smaller the output torque (specifically, engine speed fluctuation amount ΣΔNE as an index value thereof) of the diesel engine 10 generated with the fuel injection becomes. This is thought to be because the fuel is combusted in a situation where the temperature and the pressure in the combustion chamber 11*a* are low and more fuel is left uncombusted as the execution timing of the fuel injection is more retarded.

As just described, in the device of the present embodiment, when the predetermined amount of fuel is injected, the more advanced the execution timing of the fuel injection, the lower the engine speed NE during the execution, and further the higher the cetane number of the fuel, the larger the output torque of the diesel engine 10 generated with this fuel injection becomes.

Thus, in the present embodiment, the cetane number of the fuel is estimated based on the relationship of the above engine speed fluctuation amount ΣΔNE, the execution timing of the fuel injection by the estimation control, and the engine speed during injection. Since this enables the cetane number of the fuel to be estimated taking into consideration a difference in the output torque of the diesel engine 10 due to a difference in the engine speed during injection and a difference in the execution timing of the fuel injection, the cetane number can be accurately estimated.

An execution mode of such an estimation control will be specifically described below.

There is an upper limit (specifically, output torque when the fuel left uncombusted is 0) to the output torque of the diesel engine 10 generated with the execution of the injection of the predetermined amount of fuel. The above output torque reaches the upper limit in a range where the above fuel injection is executed in a situation where the engine speed NE is low (see FIG. 8) and a range where the above fuel injection is executed at an advanced timing (see FIG. 9). Since the output torque of the diesel engine 10 reaches the upper limit in such ranges without depending on the cetane number of the fuel, the cetane number of the fuel cannot be determined based on this output torque (specifically, engine speed fluctuation amount ΣΔNE).

Further, the output torque of the diesel engine 10 generated with the execution of the injection of the predetermined amount of fuel has a lower limit (output torque=0) in addition to the upper limit. The above output torque reaches the lower limit in a range where the above fuel injection is executed in a situation where the engine speed NE is high (see FIG. 8) and a range where the above fuel injection is executed at a retarded timing (see FIG. 9). Since the output torque of the diesel engine 10 reaches the lower limit in such ranges without depending on the cetane number of the fuel, the cetane number of the fuel cannot be determined based on this output torque (specifically, engine speed fluctuation amount ΣΔNE).

Because of this, in order to accurately estimate the cetane number of the fuel, it is desirable to execute the fuel injection in the estimation control in such a manner as to reduce the ranges where the output torque of the diesel engine 10 reaches the upper or lower limit.

As is clear from FIG. 9, the ranges where the output torque of the diesel engine 10 reaches the upper or lower limit are changed by changing the execution timing of the fuel injection. In view of such a characteristic, in the estimation control according to the present embodiment, a control target value of the execution timing of the fuel injection (target fuel injection timing TQsta) is set based on the engine speed NE and the fuel injection is executed at this target fuel injection timing TQsta. Specifically, the higher the engine speed NE, the more advanced timing is set as this target fuel injection timing TQsta. The following function is achieved by setting the target fuel injection timing TQsta in this way.

Since the fuel injection is executed earlier when the engine speed during injection is high, i.e. when reduction rates of the pressure and the temperature in the combustion chamber 11*a* are high, the pressure and the temperature in the combustion chamber 11*a* are prevented from becoming excessively low in a state where a large amount of the fuel is left uncombusted. This prevents much of the injected fuel from being left uncombusted without depending on the cetane number of the fuel and prevents the output torque (specifically, engine speed fluctuation amount ΣΔNE) of the diesel engine 10 from becoming excessively small.

In addition, since the fuel injection is executed at a delayed timing when the engine speed during injection is low, i.e. when the reduction rates of the pressure and the temperature in the combustion chamber 11*a* are low, the injected fuel is prevented from being combusted in a state where the pressure and the temperature in the combustion chamber 11*a* are higher than necessary. This prevents all the injected fuel from being combusted without depending on the cetane number of the fuel and prevents the output torque (specifically, engine speed fluctuation amount ΣΔNE) of the diesel engine 10 from becoming excessively large.

As just described, in the estimation control according to the present embodiment, the execution timing of the fuel injection (target fuel injection timing TQsta) can be set in accordance with the engine speed NE so that the fuel injection is executed in execution ranges where the output torque of the diesel engine 10 is unlikely to reach the upper or lower limit. Since this causes the engine speed fluctuation amount ΣΔNE to change in a relatively wide range in accordance with the cetane number of the fuel, the cetane number of the fuel can be accurately estimated based on this engine speed fluctuation amount ΣΔNE.

Even if the same amount of fuel is injected at the same execution timing, the lower the maximum value of the temperature (peak temperature) and the maximum value of the pressure (peak pressure) in the combustion chamber 11*a* of the diesel engine 10, the shorter the duration of a high-temperature, high-pressure state in the combustion chamber 11*a* becomes. Thus, the output torque of the diesel engine 10 generated with the fuel injection becomes smaller. Since the cetane number of the fuel is estimated based on the index value (specifically, engine speed fluctuation amount ΣΔNE) of the output torque of the diesel engine 10 in the estimation control of the present embodiment, a difference of such output torque contributes to reduction in cetane number estimation accuracy.

Thus, in the present embodiment, the coolant temperature THW and the supercharging pressure PA are used as setting parameters used in setting the target fuel injection timing TQsta in addition to the above engine speed NE. Specifically, the coolant temperature THW is used as a value that is an index of the peak value of the temperature in the combustion chamber 11*a* of the diesel engine 10 and the supercharging pressure PA is used as a value that is an index of the peak value of the pressure in the combustion chamber 11*a*. The target fuel injection timing TQsta is set at an advanced timing, assuming that the lower the coolant temperature PA, the lower the peak pressure of the combustion chamber 11*a* and the lower the supercharging pressure PA, the lower the peak pressure of the combustion chamber 11*a*.

By setting the target fuel injection timing TQsta according to the coolant temperature THW and the supercharging pressure PA in this way, the lower the peak temperature and the peak pressure in the combustion chamber 11*a* of the diesel engine 10, i.e. the smaller the output torque of the diesel engine 10 generated when the same amount of fuel is injected at the same injection timing, the earlier the fuel injection is executed to increase this output torque. Thus, even if the peak temperature and the peak pressure in the combustion chamber 11*a* in the execution of the fuel injection differ, a change in the output torque of the diesel engine 10 due to this difference is suppressed. Therefore, the cetane number of the fuel can be accurately estimated based on the index value (engine speed fluctuation amount ΣΔNE) of this output torque.

Since the needle valve 22 moves to close the injection hole 23 (FIG. 2), through which the fuel is being injected, during the valve closing action of the fuel injector 20, the fuel passing through the clearance between the housing 21 and the needle valve 22 acts to block the movement of this needle valve 22 toward the injection hole 23. Thus, the higher the kinetic viscosity of the fuel, the slower the moving speed of the needle valve 22, i.e. the valve closing speed of the fuel injector 20. Thus, even if the operation of the fuel injector 20 is controlled in a predetermined mode to inject a given amount of fuel, the amount of the fuel actually injected differs depending on the kinetic viscosity of the fuel. Errors in the actual fuel injection amount due to such a variation of the kinetic viscosity of the fuel contribute to reduction in cetane number estimation accuracy in the estimation control.

Thus, in the present embodiment, a target fuel injection amount (specifically, target fuel injection timing TQsta and target fuel injection time TQtma) in the estimation control is corrected by the respective correction terms K1 to K3 calculated in the correction process described above.

In the device of the present embodiment, if the moving speed of the fuel injector 20 (specifically, the needle valve 22 thereof) changes due to a variation in the kinetic viscosity of the fuel, such a change appears as a change of a fluctuating waveform (specifically, the above detection temporal waveform) of the fuel pressure inside the fuel injector 20 at the execution of the fuel injection. In the device of the present embodiment, the correction terms K1 to K3 for causing the detection temporal waveform to match the basic temporal waveform based on such a difference between the detection temporal waveform and the basic temporal waveform are calculated through the above correction process. In executing the estimation control, the target fuel injection timing TQsta and the target fuel injection time TQtma are corrected by these correction terms K1 to K3. Thus, although the moving speed of the fuel injector 20 changes due to a variation in the kinetic viscosity of the fuel, the deviation between the actual operation characteristic (detection temporal waveform) of the fuel injector 20 and the basic operation characteristic (basic temporal waveform) is suppressed. Therefore, an injection amount error due to a variation in the kinetic viscosity of the fuel is suppressed.

Further, in the present embodiment, the fuel sensor 41, which functions as a pressure sensor, is integrally attached to the fuel injector 20. Thus, as compared with a device in which a fuel pressure is detected by a sensor provided at a position distant from the fuel injector 20, a fuel pressure at a position close to the injection hole 23 of the fuel injector 20 can be detected. Thus, the fluctuating waveform of the fuel pressure inside the fuel injector 20 associated with opening and closing actions can be accurately detected. Therefore, the fluctuating waveform of the fuel pressure matching the kinetic viscosity of the fuel at each successive point in time can be detected by the fuel sensor 41 and the target fuel injection amount can be properly corrected based on this fluctuating waveform.

Further, the speed of a fluctuation wave propagating when the fuel pressure varies becomes faster as the bulk modulus of elasticity of the fuel increases. Thus, when the fluctuating state of the fuel pressure inside the fuel injector 20 is detected by the fuel sensor 41, time (above detection delay) until the fluctuation wave of the fuel pressure associated with the valve opening or closing action of this fuel injector 20 reaches the position of the fuel sensor 41 changes depending on the bulk modulus of elasticity of the fuel. Accordingly, if the detection temporal waveform is detected based on the fluctuating state of the fuel pressure PQ detected by the fuel sensor 41, even if a fixed amount of fuel is injected from the fuel injector 20, this detection temporal waveform becomes a different waveform depending on the bulk modulus of elasticity of the fuel. Thus, even if the target fuel injection timing TQsta and the target fuel injection time TQtma are corrected by the correction terms K1 to K3 calculated based on such a detection temporal waveform, the amount of the fuel actually injected differs depending on the bulk modulus of elasticity of the fuel. Errors of the actual fuel injection amount due to such a variation in the bulk modulus of elasticity of the fuel also contribute to reduction in cetane number estimation accuracy in the estimation control similarly to the error caused by the kinetic viscosity of the fuel.

Thus, in the present embodiment, the fuel temperature THQ is detected by the fuel sensor 41 immediately before the start of the execution of the fuel injection in the estimation control. Also, a correction term K4 is calculated based on the detected fuel temperature THQ, and the target fuel injection amount (specifically, target fuel injection time TQtma) is corrected by this correction term K4.

Since the bulk modulus of elasticity of the fuel changes according to the fuel temperature, an error of the actual fuel injection amount due to such a variation of the bulk modulus of elasticity of the fuel can be accurately grasped from the fuel temperature. In the present embodiment, the target fuel injection time TQtma is corrected based on such a fuel temperature. Thus, although the relationship between the fluctuating waveform of the actual fuel pressure and the fluctuating waveform of the fuel pressure PQ detected by the fuel sensor 41 becomes different due to a variation in the bulk modulus of elasticity of the fuel, an error of the actual injection amount associated with that difference is suppressed.

Further, in the present embodiment, the fuel temperature THQ immediately before the start of the execution of the fuel injection in the estimation control, i.e. the fuel temperature THQ detected at timing approximate to the actual fuel injection timing can be used for the correction of the target fuel injection amount. Thus, the target fuel injection amount can be accurately corrected in accordance with the bulk modulus of elasticity of the fuel to be actually injected.

Furthermore, in the present embodiment, the fuel sensor 41, which functions as a temperature sensor, is integrally attached to the fuel injector 20. Thus, as compared with a configuration in which a fuel temperature is detected by a sensor provided at a position (fuel tank 32 or the like) distant from the fuel injector 20, a temperature approximate to the temperature of the actually injected fuel can be detected and used for the correction of the target fuel injection amount in the estimation control. Therefore, the target fuel injection amount can be accurately corrected in accordance with the bulk modulus of elasticity of the fuel to be actually injected.

In the present embodiment, the injection amount error due to a difference in the kinetic viscosity of the fuel is corrected by the respective correction terms K1 to K3 calculated based on the fluctuating waveform of the fuel pressure PQ and the injection amount error due to a difference in the bulk modulus of elasticity of the fuel is corrected by the correction term K4 calculated based on the fuel temperature THQ. In this way, these injection amount errors are separately corrected. Thus, the injection amount difference caused by the kinetic viscosity of the fuel and that caused by the bulk modulus of elasticity of the fuel are both properly corrected. Therefore, an accurately adjusted amount of fuel can be injected from the fuel injector 20 and the cetane number of the fuel can be accurately estimated based on the index value of the output torque of the diesel engine 10 obtained as a result of that.

If the injection amount error due to a difference in the kinetic viscosity of the fuel and the injection amount error due to a difference in the bulk modulus of elasticity of the fuel can be precisely corrected by the same correction values calculated based on common calculation parameters such as fuel temperature, it is preferable since a control structure can be simplified by this.

However, as a result of various experiments by the inventors to measure the cetane number, the kinetic viscosity and the bulk modulus of elasticity of fuel, it has been found out that there is no correlation between the kinetic viscosity and the bulk modulus of elasticity of the fuel. Thus, even if an error caused by the kinetic viscosity of the fuel and an error caused by the bulk modulus of elasticity are corrected based on common parameters, one error can be compensated, but the other error cannot be precisely compensated. Therefore, this contributes to prevent an improvement of accuracy in estimating a cetane number of fuel. In addition, it is also conceivable that a decrease in the injection amount error caused by one of the kinetic viscosity and the bulk modulus of elasticity of fuel becomes smaller than an increase in the injection amount error caused by the other. In this case, accuracy in estimating a cetane number of fuel is rather reduced. Because of this, to properly correct both an injection amount error due to a variation in the kinetic viscosity of fuel and that due to a variation in the bulk modulus of elasticity, it is considered to be necessary to correct these error factors using different correction parameters.

In this respect, in the device of the present embodiment, an injection amount error due to a variation in the kinetic viscosity of fuel is corrected based on the fluctuating waveform of the fuel pressure PQ and an injection amount error due to a variation in the bulk modulus of elasticity of fuel is corrected based on the fuel temperature THQ. In this way, the respective injection amount errors are corrected using different correction parameter. Thus, these injection amount errors can be both properly corrected.

Even if fuels having the same cetane number are combusted by the same amount, the amounts of heat generated may not be necessarily the same and the amount of generated heat may vary if the fuels were produced at different times and different sites. Such a variation in the amount of heat generated by fuel causes a variation in the output torque of the diesel engine 10 when the same amount of fuel is injected and supplied to the diesel engine 10 to be combusted. Thus, even if the cetane number of the fuel is estimated based on the index value (specifically, engine speed fluctuation amount ΣΔNE) of the output torque of the diesel engine 10 generated with the execution of the injection of a predetermined amount of fuel, whether a change in the engine speed fluctuation amount ΣΔNE is caused by a difference in the cetane number or by a difference in the amount of generated heat cannot be distinguished and that estimation cannot be accurately executed.

Further, it has been found out from results of various experiments conducted by the inventors that the amount of generated heat of fuel is not correlated to the kinetic viscosity or the bulk modulus of elasticity of the fuel. Thus, to properly correct an injection amount error due to a variation in the amount of generated heat in the present embodiment, it is considered to be necessary to execute that correction using a correction parameter different from the kinetic viscosity and the bulk modulus of elasticity.

Figure 10A:
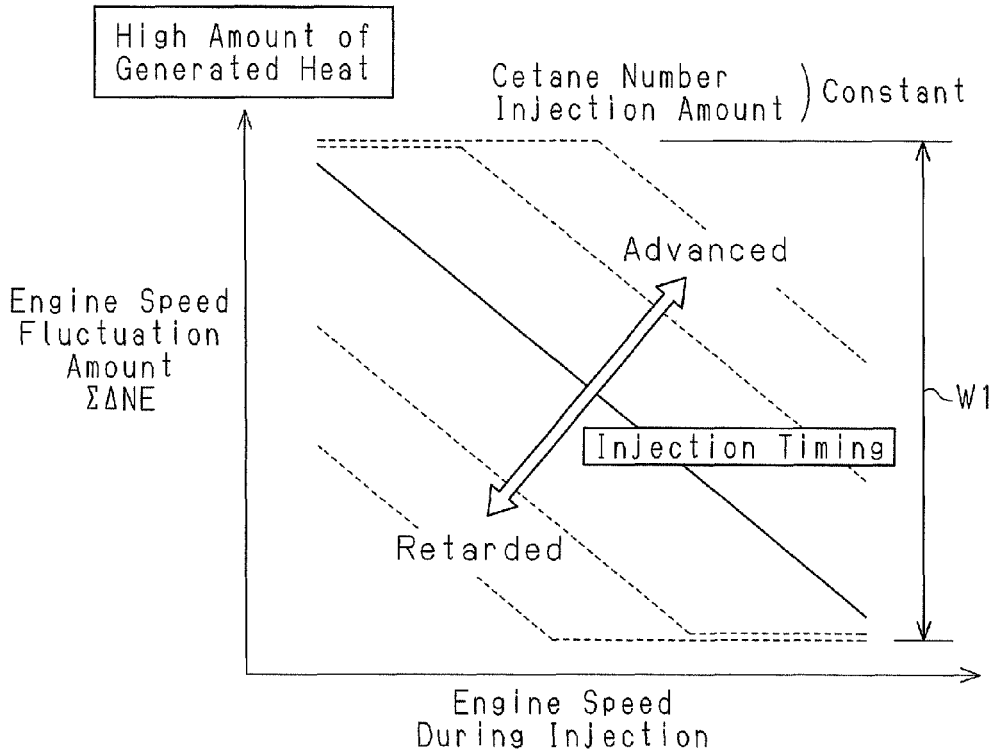
FIGS. 10(*a*) and 10(*b*) are graphs showing relationships of the engine speed fluctuation amount, the engine speed during injection, and a fuel injection timing.
Figure 10B:
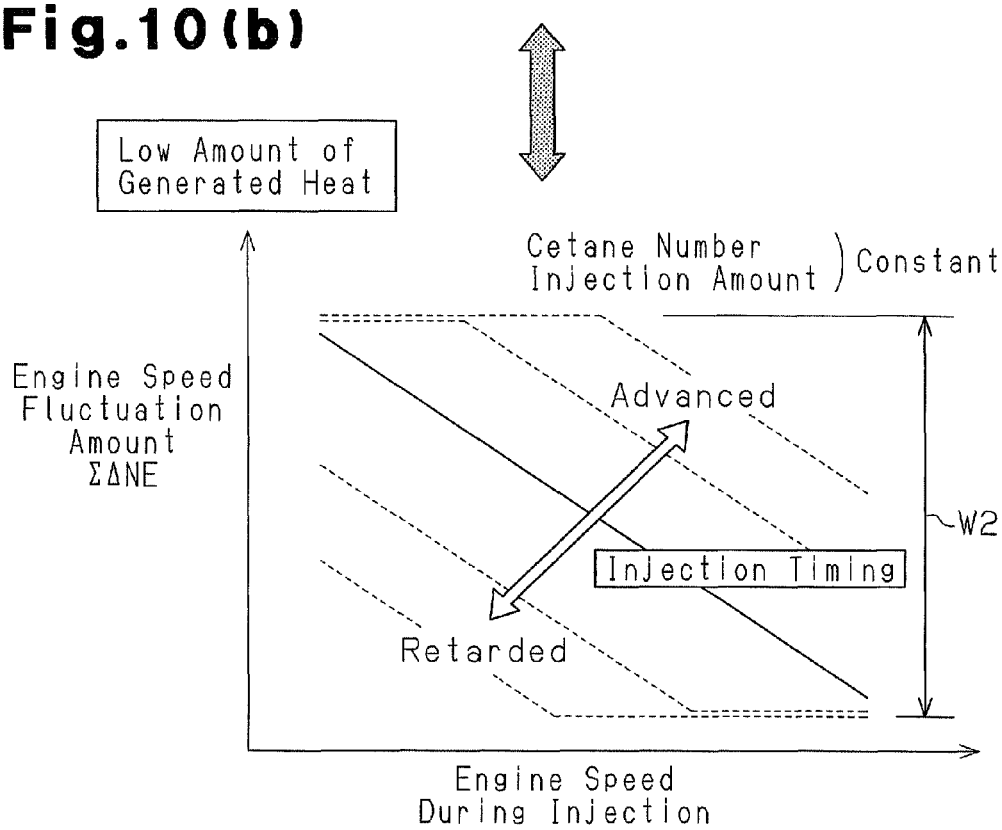

FIGS. 10(*a*) and 10(*b*) show relationships of the engine speed fluctuation amount ΣΔNE, the engine speed during injection and the fuel injection timing when the same amount of fuel having the same cetane number is injected. FIG. 10(*a*) shows the above relationship when fuel having a large amount of generated heat was used and FIG. 10(*b*) shows the above relationship when fuel having a small amount of generated heat was used.

As is clear from FIGS. 10(*a*) and 10(*b*), the upper limit of the output torque (specifically, engine speed fluctuation amount ΣΔNE as an index value thereof) of the diesel engine 10 is higher when the fuel having a large amount of generated heat was used (value indicated by W1 in FIG. 10(*a*)) than when the fuel having a small amount of generated heat was used (value indicated by W2 in FIG. 10(*b*)) if the same amount of fuel having the same cetane number is injected. Further, in this case, the upper limit of the engine speed fluctuation amount ΣΔNE is higher when the fuel having a large amount of generated heat is used.

In view of this point, in the present embodiment, an index value of an amount of heat generated by the combustion of fuel is detected and the cetane number is estimated based on this index value. Thus, when a predetermined amount of fuel is injected to estimate the cetane number of the fuel, output torque of a diesel engine generated with that fuel injection changes due to a variation of the amount of generated heat of the fuel, but the cetane number can be estimated by taking into consideration influences brought about by that change. Therefore, a cetane number estimation error due to a variation of the amount of generated heat of the fuel can be suppressed, and the cetane number of the fuel can be accurately estimated.

An execution procedure of a control for detecting an amount of generated heat of fuel (detection control) will be specifically described below.

First, fuel injection for the detection of an amount of generated heat of fuel is executed separately from fuel injection for the estimation of a cetane number of the fuel (fuel injection in the aforementioned estimation control). The fuel injection in this detection control is executed prior to the fuel injection in the estimation control. In the detection control, an index value (specifically, engine speed fluctuation amount ΣΔNE) of output torque of the diesel engine 10 generated with the execution of the fuel injection is calculated and the engine speed fluctuation amount ΣΔNE is stored as an index value of the above amount of generated heat in the electronic control unit 40.

The predetermined amount, i.e. the same amount as the fuel injection amount in the estimation control is set as a fuel injection amount in the detection control. Thus, the detection of the index value of the amount of generated heat in the detection control and the calculation of the index value of the output torque in the estimation control can be executed based on the engine speed fluctuation amount ΣΔNE obtained as a result of combusting the same amount of the fuel. Therefore, the index value of the amount of generated heat detected in the detection control can be easily used for the estimation of the cetane number in the estimation control.

Figure 11:
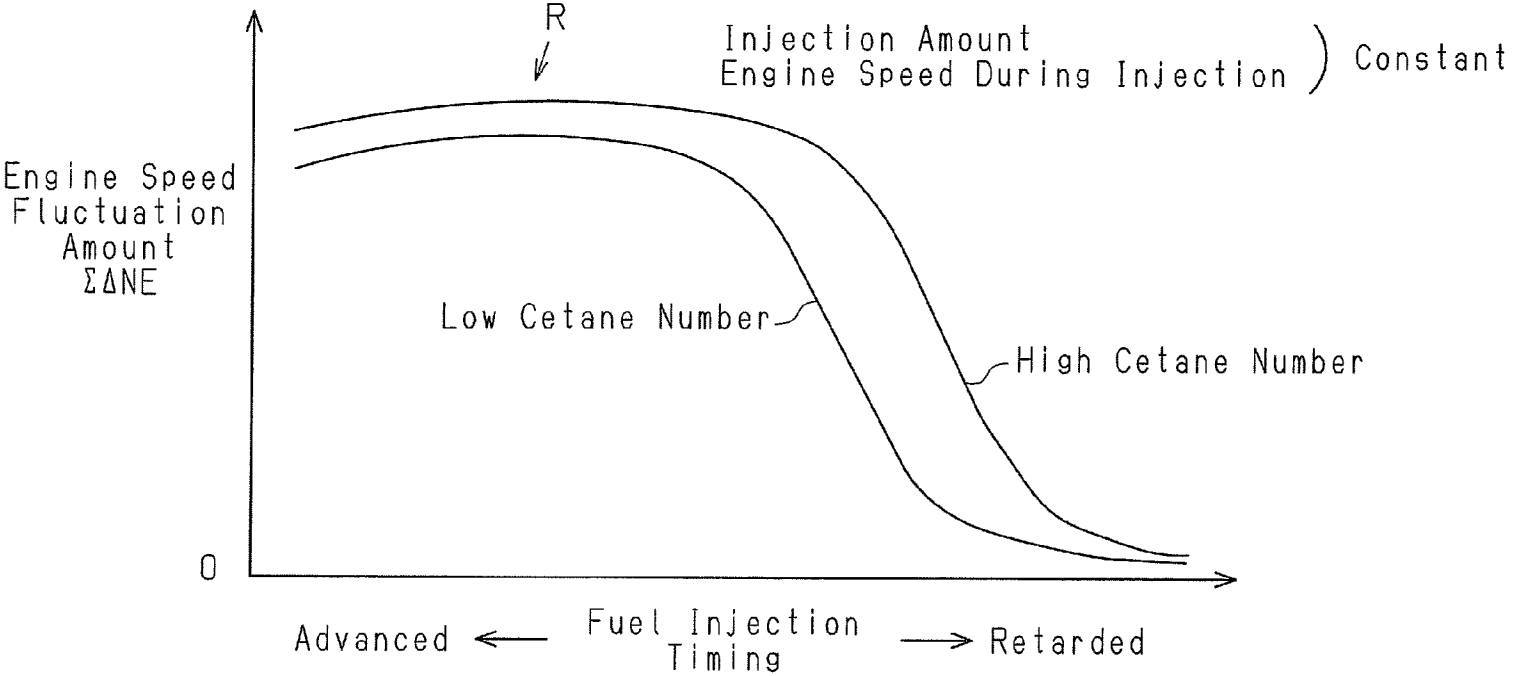
FIG. 11 is a graph showing a relationship of the cetane number of fuel, the engine speed fluctuation amount, and the fuel injection timing.

Further, timing at which uncombusted fuel is as little as possible is set as execution timing (target injection timing TQstb, which will be discussed below) of the fuel injection in the detection control. FIG. 11 shows a relationship of the cetane number of the fuel, the engine speed fluctuation amount ΣΔNE and the fuel injection timing under state of the same fuel injection amount and engine speed during injection. As shown in FIG. 11, in an engine operation region where the engine speed during injection is low and the fuel injection timing is an advanced timing, there is a range (range indicated by an arrow R in FIG. 11) where the engine speed fluctuation amount ΣΔNE hardly changes even if the cetane number of the fuel changes. This is thought to be because this engine operation region is a region where the fuel is exposed to a high-temperature, high-pressure environment for a long time in the cylinder 11 of the diesel engine 10, and a very small amount of the fuel is left uncombusted. Since a detection error caused by the uncombusted fuel becomes very small by executing the fuel injection at such timing in the detection control of the present embodiment, the index value of the output torque of the diesel engine 10 generated when the predetermined amount of the fuel is combusted and, consequently, the index value of the amount of generated heat can be accurately detected. Timing at which the fuel is actually ignited at a compression top dead center (in the present embodiment, BTDC10° CA to 5° CA) is specifically set as the target injection timing TQstb in the detection control.

In the detection control of the present embodiment, by executing the fuel injection based on such fuel injection amount and target injection timing TQstb, a value matching the tendency that the higher the amount of generated heat of the fuel used, the larger the output torque of the diesel engine 10 when the predetermined amount of the fuel is combusted is detected as the index value of the amount of generated heat.

Further, in the fuel injection in the detection control, the coolant temperature THW, the supercharging pressure PA and the respective correction terms K1 to K4 are used as setting parameters of the target injection amount (specifically, target injection timing TQstb and target injection time TQtmb) similarly to the fuel injection in the estimation control. Specifically, an injection amount difference caused by a variation of the peak temperature in the combustion chamber 11*a* of the diesel engine 10 is suppressed by setting the target injection timing TQstb based on the coolant temperature THW. Further, an injection amount difference caused by a variation of the peak pressure in the combustion chamber 11*a* of the diesel engine 10 is suppressed by setting the target injection timing TQstb based on the supercharging pressure PA. Furthermore, an injection amount error caused by a variation of the kinetic viscosity of the fuel is suppressed by correcting the target injection timing TQstb and the target injection time TQtmb by the respective correction terms K1 to K3. Further, an injection amount error caused by a variation of the bulk modulus of elasticity of the fuel is suppressed by correcting the target injection time TQtmb by the correction term K4.

Execution procedures of a process relating to the detection control (detection control process) and a process relating to the estimation control (estimation control process) are described in detail below.

The execution procedure of the detection control process will first be described in detail with reference to FIG. 12.

Figure 12:
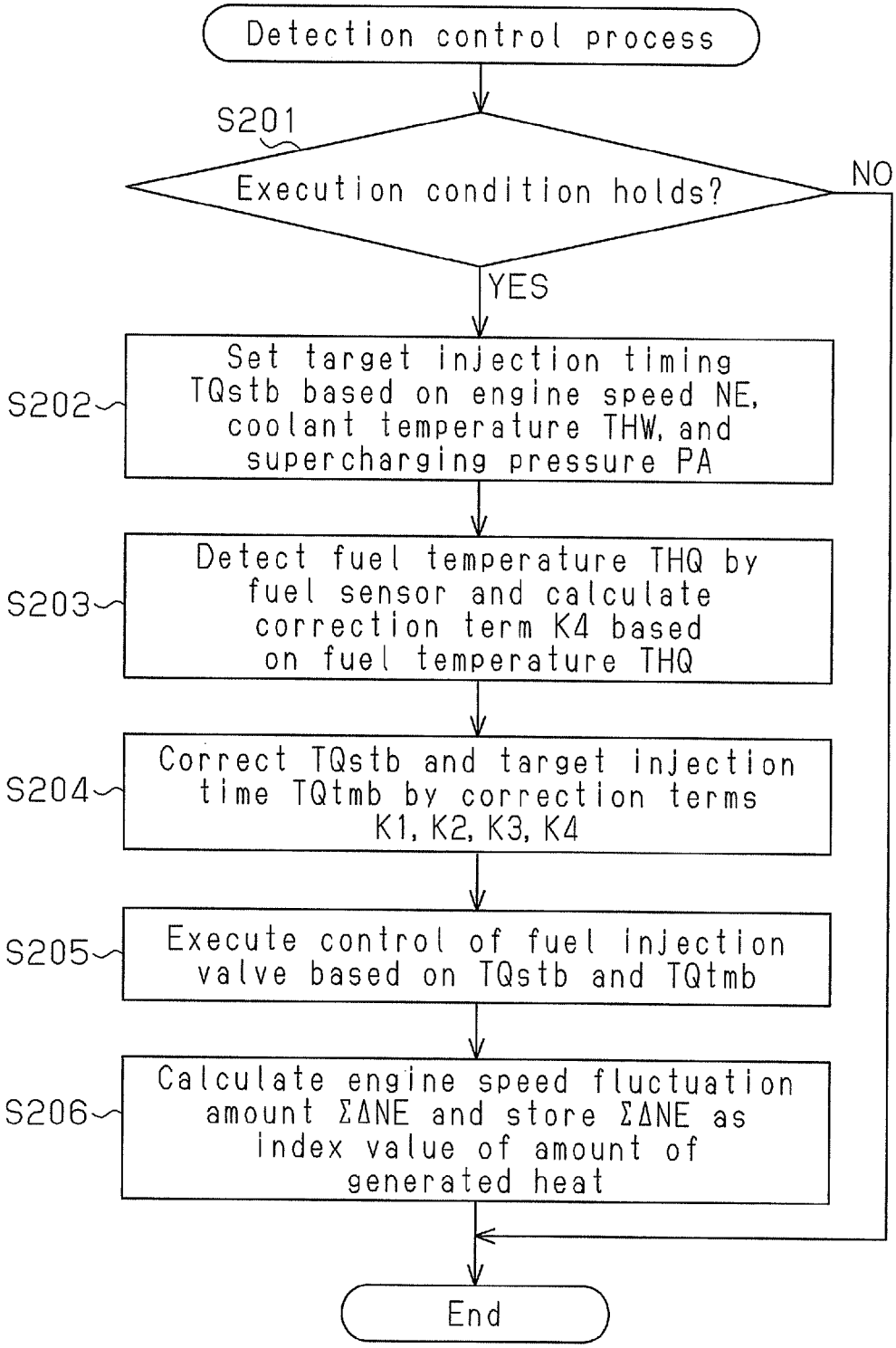
FIG. 12 is a flowchart showing an execution procedure of a detection control process.

FIG. 12 is a flowchart showing a specific execution procedure of the above detection control process. A series of processings shown in this flowchart conceptually show the execution procedure of the detection control process and actual processings are performed as interrupt processing in each predetermined cycle by the electronic control unit 40.

As shown in FIG. 12, in this process, whether or not an execution condition holds is first determined (step S201). The execution condition is determined to hold when all of the following [Condition A] to [Condition D] are satisfied.

[Condition A] A control is being executed that temporarily stops fuel injection for the operation of the diesel engine 10 during deceleration of the running speed of the vehicle 1 and the engine speed NE caused by cancelling operation of the accelerator operating member (fuel cutoff control).

[Condition B] The clutch mechanism 2 is in an operating state to disconnect the crankshaft 14 from the manual transmission 3. Specifically, the clutch operating member is operated.

[Condition C] There is no history of completing the detection of the amount of generated heat of the fuel after it is determined that the fuel has been supplied to the fuel tank 32. It is determined that the fuel has been supplied to the fuel tank 32 when a fuel reserve amount detected by the reserve amount sensor 45 has increased to or above a predetermined determination amount. In this process, the detection of the amount of generated heat of the fuel is executed only once each time the fuel is supplied since this [Condition C] is set.

[Condition D] The fuel in a fuel path (specifically, the path formed by the branch passage 31*a*, the supply passage 31*b*, the common rail 34 and the return passage 35) connecting the fuel tank 32 and the fuel injector 20 is replaced by fuel newly supplied from the fuel tank 32 after it is determined that the fuel has been supplied to the fuel tank 32.

That the above [Condition D] is satisfied is specifically determined as follows. That is, each time the fuel is injected from each fuel injector 20 after it is determined that the fuel has been supplied to the fuel tank 32, the amount of the fuel leaking into the return passage 35 from the interior of the fuel injector 20 is estimated based on the above detection temporal waveform (see FIGS. 5 and 6) and the characteristic of the fuel injector 20, and an integrated value of the estimated amount is calculated. If this integrated value becomes equal to or more than the predetermined determination amount, it is determined that the [Condition D] is satisfied. In the present embodiment, the replacement of the fuel in the return passage 35 by the fuel newly supplied to the fuel tank 32 after the fuel supply is detected based on the amount of the fuel leaking into the return passage 35 from the interior of the fuel injector 20 and the replacement of the fuel in the above fuel path is detected with this detection.

The above [Condition D] is set for the following reason. There is a possibility that the amount of generated heat and the cetane number of the fuel supplied to the diesel engine 10 largely change when the fuel is supplied to the fuel tank 32. Thus, in efficiently detecting the amount of generated heat of the fuel at an appropriate timing prior to the estimation of the cetane number of the fuel, it is considered to be effective to execute the detection when the fuel is supplied to the fuel tank 32. However, since the fuel before the fuel supply remains in the above fuel path immediately after the fuel is supplied to the fuel tank 32, a value matching the fuel after the fuel supply cannot be detected as the amount of generated heat even if the aforementioned fuel injection is executed to detect the amount of generated heat of the fuel at this time. In this respect, since the [Condition D] is set in the present embodiment, the fuel injection for the detection of the amount of generated heat is executed after waiting until the fuel in the above fuel path is replaced by the fuel after the fuel supply when the fuel is supplied to the fuel tank 32. Therefore, the fuel injection for the detection of the amount of generated heat of the fuel can be executed at an appropriate timing and the amount of generated heat can be accurately estimated through this fuel injection.

If the above execution condition does not hold (step S201: NO), this process is temporarily suspended without performing the following processings, i.e. processings of detecting the amount of generated heat of the fuel.

Thereafter, when this process is repeatedly performed and the above execution condition holds (step S201: YES), the target injection timing TQstb is set based on the engine speed NE, the coolant temperature THW and the supercharging pressure PA at this time (step S202). The higher the engine speed NE, the more advanced the set target injection timing TQstb becomes.

Further, the fuel temperature THQ is detected by the fuel sensor 41 and the correction term K4 is calculated based on this fuel temperature THQ (step S203). As just described, in this process, the fuel temperature THQ is detected by the fuel sensor 41 at timing immediately before the start of the execution of the fuel injection in the detection control (specifically, at timing between the holding of the execution condition and the execution of the fuel injection). Thus, the fuel temperature THQ detected at timing approximate to timing at which the fuel is actually injected in the detection control can be used for the correction of the target injection amount, wherefore the target injection amount can be accurately corrected in accordance with the bulk modulus of elasticity of the fuel to be actually injected. This detection of the fuel temperature THQ is executed after the fuel sensor 41 is temporarily switched to a state where it functions as a temperature sensor by the input of a signal from the electronic control unit 40.

In the present embodiment, a relationship between the fuel temperature THQ and the correction term K4 capable of precisely suppressing the injection amount error due to a variation of the bulk modulus of elasticity of fuel is obtained in advance based on results of experimentation and simulation and stored in the electronic control unit 40. In step S203, the correction term K4 is set based on this relationship and the fuel temperature THQ.

In the fuel injector 20 of the present embodiment, the higher the fuel temperature, i.e. the higher the bulk modulus of elasticity of the fuel, the more likely the area of the detection temporal waveform in the case of driving the fuel injector 20 in the same state becomes smaller. The following is thought to be a cause of this. The higher the fuel temperature and the higher the bulk modulus of elasticity of the fuel, the faster the propagation speed of a pressure fluctuation wave inside the fuel injector 20 becomes. Thus, the fluctuation wave of the fuel pressure associated with the valve closing of the fuel injector 20 reaches the position of the fuel sensor 41 earlier. Since this increases the increasing rate of the fuel pressure PQ detected by the fuel sensor 41 in the process of closing the fuel injector 20, the area of the detection temporal waveform becomes smaller by that much. In the present embodiment, if the area of the detection temporal waveform becomes smaller in such a way, the fuel injection amount from the fuel injector 20 is corrected to increase in a fuel injection control to compensate for an area reduction. Thus, in step S203, a value for shortening the target injection time TQtmb with an increase in the fuel temperature THQ is calculated as the correction term K4 to suppress such a change in the fuel injection amount.

Thereafter, the target injection amount (target injection timing TQstb and target injection time TQtmb) is corrected by the correction terms K1 to K3 calculated by the aforementioned correction process and the above correction term K4 (step S204). Specifically, the value obtained by adding the correction term K1 to the target injection timing TQstb is set as a new target injection timing TQstb, and the value obtained by adding the correction terms K2, K3 and K4 to the target injection time TQtmb is set as a new target injection time TQtmb.

Then, the control of the fuel injector 20 is executed based on the target injection timing TQstb and the target injection time TQtmb to execute fuel injection of this fuel injector 20 (step S205). This fuel injection is executed using a predetermined one of the plurality of fuel injectors 20 (in the present embodiment, the fuel injector 20 mounted in the cylinder 11[#1]). Further, values calculated in correspondence with a predetermined one of the fuel injectors 20 (in the present embodiment, the fuel injector 20 mounted in the cylinder 11[#1]) are similarly used for the correction terms K1 to K3 used in this process.

Figure 13:
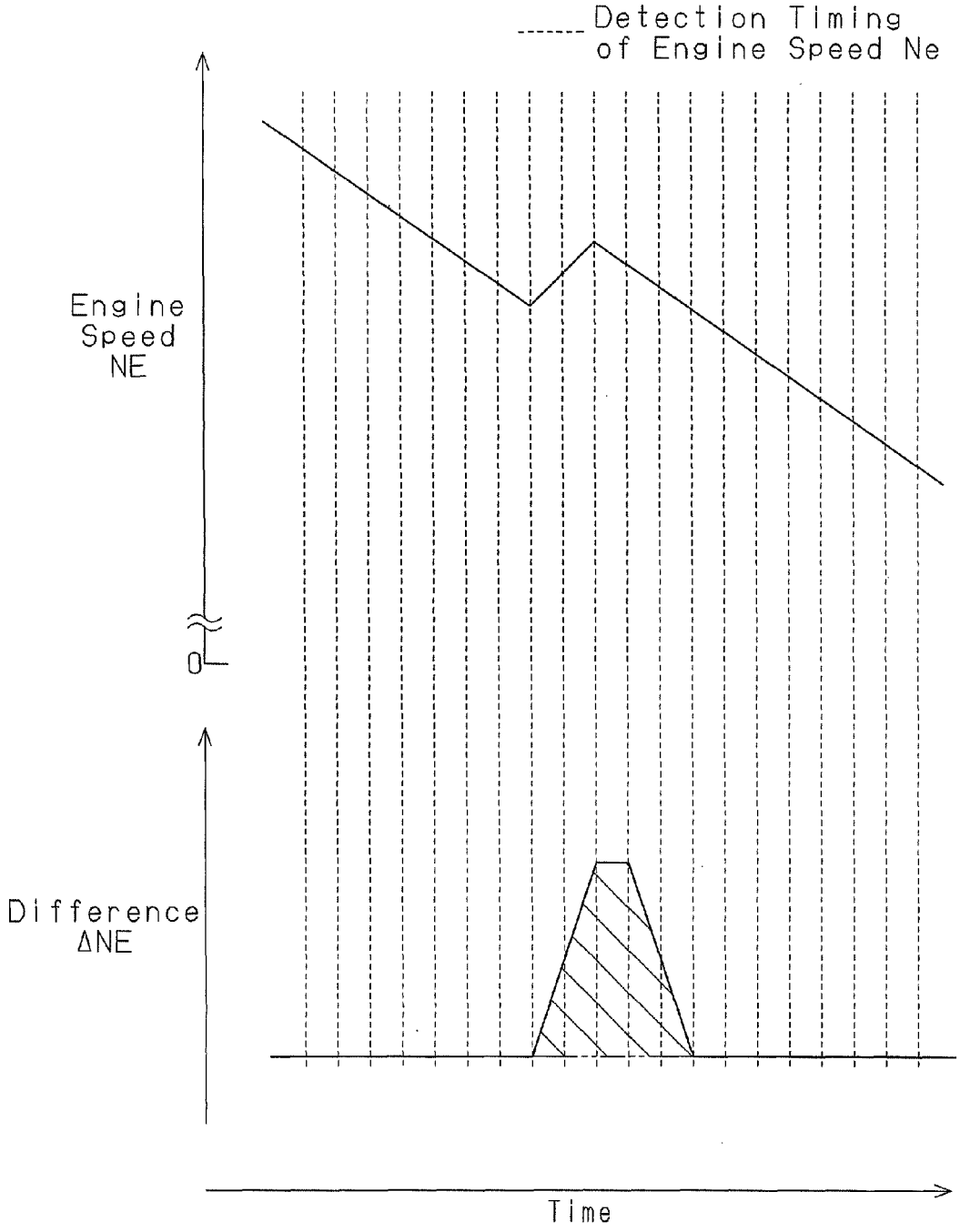
FIG. 13 is a chart showing a method for calculating the engine speed fluctuation amount.

Then, after the index value (the above engine speed fluctuation amount ΣΔNE) of the output torque of the diesel engine 10 generated with the above fuel injection is calculated and this engine speed fluctuation amount ΣΔNE is stored as the index value of the amount of generated heat (step S206), this process is temporarily suspended. The engine speed fluctuation amount ΣΔNE is specifically calculated as follows. As shown in FIG. 13, in the device according to the present embodiment, the engine speed NE is detected at predetermined time intervals and the difference ΔNE (ΔNE=NE−NEi) between this engine speed NE and an engine speed NEi detected in the past (nth one counted from the current one, third one in the present embodiment) is calculated each time that detection is made. Then, an integrated value (value equivalent to an area shown by oblique lines in FIG. 13) is calculated for the change of the above difference ΔNE accompanying the execution of the above fuel injection. The integrated value is stored as the above engine speed fluctuation amount ΣΔNE. Changes in the engine speed NE and the difference ΔNE shown in FIG. 13 slightly differ from the actual changes since they are shown in a simplified manner to make a calculation method of the engine speed fluctuation amount ΣΔNE easily understandable.

Next, the execution procedure of the above estimation control process will be described in detail.

Figure 14:
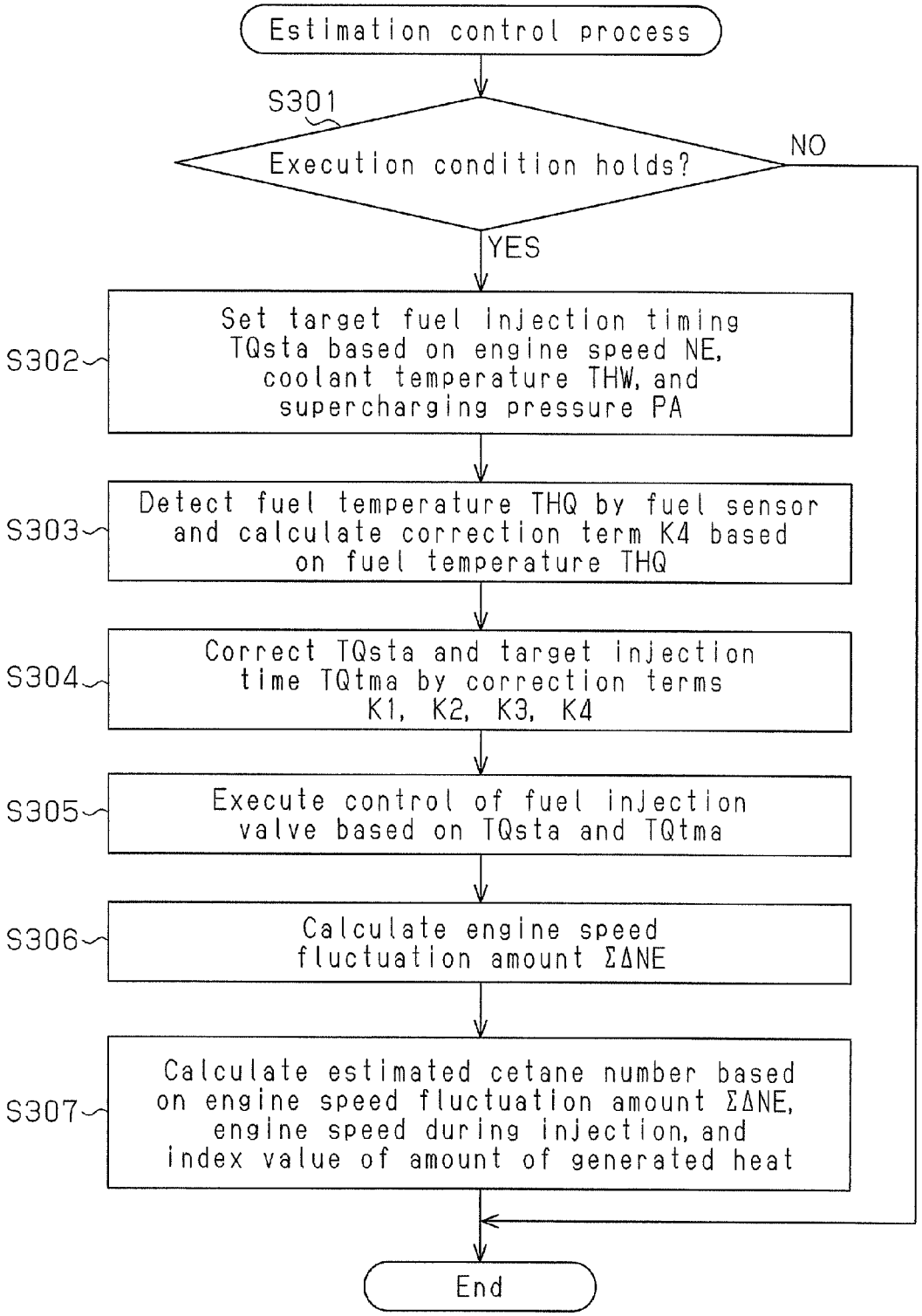
FIG. 14 is a flowchart showing an execution procedure of an estimation control process.

FIG. 14 is a flowchart showing a specific execution procedure of the above estimation control process. A series of processings shown in this flowchart conceptually show the execution procedure of the estimation control process and actual processings are performed as interrupt processing in each predetermined cycle by the electronic control unit 40.

As shown in FIG. 14, in this process, whether or not an execution condition holds is first determined (step S301). The execution condition is determined to hold when all of the above conditions [Condition A] and [Condition B] and the following [Condition E] are satisfied.

[Condition E] There is a history of completing the detection of the amount of generated heat of the fuel in the above detection control process after it is determined that the fuel has been supplied to the fuel tank 32.

If the above execution condition does not hold (step S301: NO), this process is temporarily suspended without performing the following processings, i.e. processings of estimating the cetane number of the fuel.

Thereafter, when this process is repeatedly performed and the above execution condition holds (step S301: YES), the target injection timing TQsta is set based on the engine speed NE, the coolant temperature THW and the supercharging pressure PA at this time (step S302).

Further, the fuel temperature THQ is detected by the fuel sensor 41 and the correction term K4 is calculated based on this fuel temperature THQ (step S303). As just described, in this process, the fuel temperature THQ is detected by the fuel sensor 41 at timing immediately before the start of the execution of the fuel injection in the estimation control (specifically, at timing between the holding of the execution condition and the execution of the fuel injection). In this processing of step S303, a value for shortening the target injection time TQtma with an increase in the fuel temperature THQ is calculated as the correction term K4 to suppress a change of the fuel injection amount due to a variation of the bulk modulus of elasticity of the fuel.

Thereafter, the target fuel injection amount (target fuel injection timing TQsta and target fuel injection time TQtma) is corrected by the correction terms K1 to K3 calculated by the aforementioned correction process and the above correction term K4 (step S304). Specifically, the value obtained by adding the correction term K1 to the target fuel injection timing TQsta is set as a new target fuel injection timing TQsta and the value obtained by adding the correction terms K2, K3 and K4 to the target fuel injection time TQtma is set as a new target fuel injection time TQtma.

Then, the control of the fuel injector 20 is executed based on the target fuel injection timing TQsta and the target fuel injection time TQtma to execute fuel injection from this fuel injector 20 (step S305). This fuel injection is executed using a predetermined one of the plurality of fuel injectors 20 (in the present embodiment, the fuel injector 20 mounted in the cylinder 11[#1]). Further, values calculated in correspondence with a predetermined one of the fuel injectors 20 (in the present embodiment, the fuel injector 20 mounted in the cylinder 11[#1]) are similarly used for the correction terms K1 to K3 used in this process.

Thereafter, the index value (above engine speed fluctuation amount ΣΔNE) of the output torque of the diesel engine 10 generated with the above fuel injection is calculated (step S306).

Then, an estimated value of the cetane number of the fuel (estimated cetane number) is calculated based on the engine speed fluctuation amount ΣΔNE, the engine speed during injection and the index value of the amount of generated heat detected in the detection control process (step S307). In the present embodiment, a relationship of the estimated cetane number, the engine speed fluctuation amount ΣΔNE and the engine speed during injection capable of accurately estimating the cetane number of fuel when the estimation control process is performed using fuel having a predetermined amount of generated heat (relationship as shown in FIG. 8) is obtained in advance based on results of experimentation and simulation and stored in the electronic control unit 40. In step S307, the above relationship (estimation map) is corrected based on the difference between the actual amount of generated heat grasped from the above index value of the amount of generated heat and a predetermined amount of generated heat. Then, the estimated cetane number is calculated from the corrected estimation map based on the engine speed fluctuation amount ΣΔNE and the engine speed during injection.

After the estimated cetane number is calculated in this way, this process is temporarily suspended.

In the device according to the present embodiment, various processes are performed based on an output signal of the fuel sensor 41 corresponding to each of the cylinders 11 (#1 to #4) of the diesel engine 10 such as the execution of various processes (process relating to the fuel injection control and correction process) for the fuel injection for the cylinder 11 [#1] based on a detection signal of the fuel sensor 41 provided in the cylinder 11 [#1] of the diesel engine 10. Thus, in the multi-cylinder diesel engine 10, in which the operation characteristic of the fuel injector 20 differs among the respective cylinders 11 due to the initial individual difference and changes over time, the amount of the fuel injected from each fuel injector 20 can be accurately adjusted based on the fuel pressure PQ detected by the dedicated fuel sensor 41 provided in each cylinder 11.

In addition, using one of these fuel injectors 20 (in the present embodiment, fuel injector 20 corresponding to the cylinder 11 [#1]), the fuel injection in the detection control and that in the estimation control are executed based on the correction terms K1 to K3 calculated in the fuel injection control of this fuel injector 20. Since the amount of the fuel to be actually injected in the detection control and the estimation control are accurately adjusted in this way, the cetane number of the fuel can be accurately estimated based on the output torque of the diesel engine 10 generated with that fuel injection.

As described above, the following advantages are achieved according to the present embodiment.

(1) The index value of the amount of generated heat associated with fuel combustion is detected and the cetane number is estimated based on this index value. Thus, an estimation error of the cetane number due to a variation of the amount of generated heat of the fuel is suppressed, and the cetane number of the fuel is accurately estimated.

(2) The predetermined amount of the fuel is injected in the detection control process, the index value (engine speed fluctuation amount ΣΔNE) of the output torque of the diesel engine 10 generated with the execution of this fuel injection is calculated and this engine speed fluctuation amount ΣΔNE is detected as an index value of the amount of generated heat. Thus, a value matching a tendency that the higher the amount of generated heat of fuel used, the larger the output torque of the diesel engine 10 in the case of combusting a predetermined amount of fuel is detected as an index value of the amount of generated heat.

(3) The target injection amount for the fuel injection in the detection control is corrected based on the fluctuating waveform of the fuel pressure PQ detected by the fuel sensor 41. Thus, although the moving speed of the fuel injector 20 changes due to a variation of the bulk modulus of elasticity of the fuel, the deviation between the actual operation characteristic of the fuel injector 20 and the basic operation characteristic is suppressed, and an injection amount error due to a variation of the kinetic viscosity of the fuel is suppressed. Therefore, an accurately adjusted amount of the fuel is injected from the fuel injector 20, and the amount of generated heat of the fuel is accurately detected based on the index value of the output torque of the diesel engine 10 obtained as a result of that.

(4) The target injection timing TQstb and the target injection time TQtmb are corrected by the correction terms K1 to K3 calculated based on the difference between the detection temporal waveform and the basic temporal waveform. Thus, although the moving speed of the fuel injector 20 changes due to a variation of the kinetic viscosity of the fuel, the deviation between the actual operation characteristic of the fuel injector 20 and the basic operation characteristic is suppressed and an injection amount error due to a variation of the kinetic viscosity of the fuel is suppressed.

(5) The target injection amount for the fuel injection in the detection control is corrected based on the fuel temperature THQ detected by the fuel sensor 41. Thus, although the relationship between the fluctuating waveform of the actual fuel pressure and the fluctuating waveform of the fuel pressure PQ detected by the fuel sensor 41 differs due to a variation of the bulk modulus of elasticity of the fuel, an error of the actual fuel injection amount associated with that difference is suppressed. Therefore, an accurately adjusted amount of the fuel is injected from the fuel injector 20, and the amount of generated heat of the fuel is accurately detected based on the index value of the output torque of the diesel engine 10 obtained as a result of that.

(6) The fuel temperature THQ is detected immediately before the start of the execution of the fuel injection in the detection control and the target injection amount in the detection control is corrected based on the detected fuel temperature THQ. Thus, the target injection amount is accurately corrected in accordance with the bulk modulus of elasticity of the fuel to be actually injected.

(7) The target fuel injection amount for the fuel injection in the estimation control is corrected based on the fluctuating waveform of the fuel pressure PQ detected by the fuel sensor 41. Thus, an accurately adjusted amount of the fuel is injected from the fuel injector 20 and the cetane number of the fuel is accurately estimated based on the index value of the output torque of the diesel engine 10 obtained as a result of that.

(8) The target fuel injection amount in the estimation control is corrected based on the fuel temperature THQ detected by the fuel sensor 41. Thus, an accurately adjusted amount of the fuel is injected from the fuel injector 20 and the cetane number of the fuel is accurately estimated based on the index value of the output torque of the diesel engine 10 obtained as a result of that.

(9) The target fuel injection timing TQsta and the target fuel injection time TQtma are corrected by the correction terms K1 to K3 calculated based on the difference between the detection temporal waveform and the basic temporal waveform. Thus, an injection amount error in the estimation control due to a variation of the kinetic viscosity of the fuel is suppressed.

(10) The fuel temperature THQ is detected immediately before the start of the execution of the fuel injection in the estimation control and the target fuel injection amount in the estimation control is corrected based on the detected fuel temperature THQ. Thus, the target fuel injection amount is accurately corrected in accordance with the bulk modulus of elasticity of the fuel to be actually injected.

(11) Since the fuel sensors 41, which function as pressure sensors, are each integrally attached to a fuel injector 20, a fluctuating waveform matching the kinetic viscosity of the fuel at each successive point in time is detected by each fuel sensor 41, and the target fuel injection amount in the detection control and that in the estimation control is properly corrected based on this fluctuating waveform.

The above embodiment may be modified as follows.

The configuration for setting the target fuel injection timing TQsta (or target injection timing TQstb) based on the coolant temperature THW and the configuration for setting the target fuel injection timing TQsta (or target injection timing TQstb) based on the supercharging pressure PA may be omitted. In this case, the coolant temperature THW and the supercharging pressure PA may be added as parameters used in the detection of the index value of the amount of generated heat (or in the calculation of the estimated cetane number) such as by correcting the engine speed fluctuation amount ΣΔNE based on the coolant temperature THW or by correcting the engine speed fluctuation amount ΣΔNE based on the supercharging pressure PA. Also by such a configuration, the amount of generated heat is detected (or the estimated cetane number is calculated) in accordance with the peak temperature and the peak pressure in the combustion chamber 11*a* at the execution of the fuel injection and the cetane number of the fuel is accurately estimated.

If a region where the output torque of the diesel engine 10 reaches neither the upper limit nor the lower limit is sufficiently wide, the configuration for variably setting the target fuel injection timing TQsta according to the engine speed NE may be omitted.

The estimated cetane number is calculated based on the engine speed fluctuation amount ΣΔNE and the index value of the amount of generated heat without using the engine speed during injection as a calculation parameter. Specifically, when the engine speed NE is predetermined, the fuel injection for estimating the cetane number of the fuel may be executed and the estimated cetane number may be calculated based on the engine speed fluctuation amount ΣΔNE calculated at this time.

In calculating the estimated cetane number, a plurality of operation maps defining different relationships depending on the index value of the amount of generated heat may be prepared instead of correcting the estimation map based on the index value of the amount of generated heat, and the estimated cetane number may be calculated from the relationship stored in the selected operation map based on the detected index value of the amount of generated heat.

In the above embodiment, in the estimation control process, the estimation map is corrected based on the index value of the amount of generated heat and the estimated cetane number is calculated from the corrected estimation map based on the index value (engine speed fluctuation amount ΣΔNE) of the output torque. Instead of this, the engine speed fluctuation amount ΣΔNE may be corrected based on the index value of the amount of generated heat and the estimated cetane number may be calculated from the estimation map based on the corrected engine speed fluctuation amount ΣΔNE. Further, the target fuel injection amount in the estimation control process may be corrected based on the index value of the amount of generated heat and the estimated cetane number may be calculated from the estimation map based on the engine speed fluctuation amount ΣΔNE obtained as a result of the fuel injection based on the corrected target fuel injection amount. Since the cetane number is estimated based on the index value of the amount of generated heat of the fuel also by such a configuration, a cetane number estimation error due to a variation of the amount of generated heat of the fuel is suppressed.

The process for detecting the index value of the amount of generated heat of the fuel in the detection control may be executed prior to the process for calculating the engine speed fluctuation amount ΣΔNE in the estimation control. Also by such a configuration, the estimated cetane number is calculated based on the index value of the amount of generated heat and the engine speed fluctuation amount ΣΔNE.

The calculation of the estimated cetane number based on the index value (engine speed fluctuation amount ΣΔNE) of the output torque of the diesel engine 10 may be executed in accordance with an arithmetic expression instead of calculating in accordance with the estimation map. In short, it is sufficient to store a relationship between the estimated cetane number and the engine speed fluctuation amount ΣΔNE in the electronic control unit 40 in advance and calculate the estimated cetane number from this relationship.

Detection timing of the fuel temperature THQ as a calculation parameter of the correction term K4 is not limited to timing immediately before the execution of the fuel injection in the detection control (or estimation control) and may be changed to an arbitrary timing. In short, it is sufficient if the temperature of the fuel to be injected can be accurately grasped prior to the execution of the fuel injection in the detection control (or estimation control). Specifically, the fuel temperature THQ detected in executing another engine control such as a fuel injection control can be used as the calculation parameter of the correction term K4.

The process for calculating the correction term K4 and the process for correcting the target fuel injection time TQtma and the target injection time TQtmb based on this correction term K4 may also be omitted.

The cetane number estimation device according to the embodiment can also be applied to a device in which only the correction terms K1, K2 are calculated without the correction term K3 being calculated in the fuel injection control.

In the embodiment, the target injection amount in the detection control and the target fuel injection amount in the estimation control are corrected by the respective correction terms K1 to K3 calculated in the fuel injection control. Instead of this, fuel injection dedicated for the calculation of correction terms for correcting the target injection amount in the detection control and the target fuel injection amount in the estimation control may be executed and the correction terms may be calculated based on a difference between the actual operation characteristic (detection temporal waveform) of the fuel injector 20 and a predetermined basic operation characteristic (basic temporal waveform) at the execution of this fuel injection.

Specifically, the correction terms can be calculated based on a difference between a completion timing of a valve closing action in the actual operation characteristic of the fuel injector 20 and that of a valve closing action of the fuel injector 20 in the basic operation characteristic. As described above, the higher the kinetic viscosity of the fuel, the slower the valve closing speed of the fuel injector 20 becomes. Thus, when the valve closing action of the fuel injector 20 changes due to a variation of the kinetic viscosity of the fuel, such a change appears as a difference in the completion timing of the valve closing action between the actual operation characteristic of the fuel injector 20 and the basic operation characteristic. In this respect, according to the above configuration, the correction terms for correcting the target injection amount in the detection control process and the target fuel injection amount in the estimation control process can be calculated using such a difference in the completion timing of the valve closing action as an index value of the kinetic viscosity of the fuel. Thus, an injection amount error due to a variation of the kinetic viscosity of the fuel is suppressed based on these correction values. In addition, values equivalent to the above correction terms K1 to K3 are also calculated as the above correction terms. In short, any values capable of properly suppressing the deviation between the actual operation characteristic of the fuel injector 20 and the basic operation characteristic can be used as the above correction terms.

The cetane number estimation device according to the above embodiment can be applied not only to the vehicle 1, in which the clutch mechanism 2 and the manual transmission 3 are installed, but also a vehicle in which a torque converter and an automatic transmission are installed. In this case, fuel injection for detecting an amount of generated heat of fuel and fuel injection for estimating a cetane number may be executed on the condition that a fuel cutoff control is in execution.

A value other than the engine speed fluctuation amount ΣΔNE may be calculated as the index value of the output torque of the diesel engine 10. For example, the engine speed NE when fuel injection is executed (engine speed during injection) and the engine speed NE when the fuel injection is not executed may be respectively detected during the execution of the detection control or the estimation control. In this case, the difference between these speeds is calculated and the difference is used as the above index value.

A value other than the engine speed fluctuation amount ΣΔNE may be calculated as the index value of the amount of generated heat. For example, the peak temperature and the peak pressure in each cylinder 11 of the diesel engine 10 when the predetermined amount of fuel is injected may be detected and these may be stored as index values in the electronic control unit 40.

The fuel injection amount in the detection control and that in the estimation control may be set at different amounts.

Instead of using the coolant temperature THW, a value that is an index of the peak temperature in the combustion chambers 11*a* and is other than the coolant temperature THW such as the temperature of the diesel engine 10 (specifically, the cylinder head or the cylinder block thereof) or the temperature of intake air may be used as a setting parameter of the target fuel injection timing TQsta and the target injection timing TQstb. Further, it is also possible to directly detect the temperature in each combustion chamber 11*a* and use this as the above setting parameter.

Instead of using the supercharging pressure PA, a value that is an index of the peak pressure in the combustion chamber 11*a* and is other than the supercharging pressure PA such as the pressure of intake air or atmospheric pressure can be used as a setting parameter of the target fuel injection timing TQsta and the target injection timing TQstb. Further, it is also possible to directly detect a pressure in the combustion chamber 11*a* and use this as the above setting parameter. Such a configuration can also be applied to a diesel engine in which the supercharger 16 is not provided. Since a peak pressure in the combustion chamber 11*a* slightly differs depending on operating state and operating environment of the diesel engine even if the supercharger 16 is not provided in the diesel engine, accuracy in estimating the cetane number of fuel can be improved by correcting an injection timing based on this peak pressure (or an index value thereof).

The method for determining that the fuel has been supplied to the fuel tank 32 is not limited to the determination method based on a detection signal of the reserve amount sensor 45 and an arbitrary method such as a determination method based on the opening and closing of the lid of the fuel tank 32 may be adopted.

The method for determining the replacement of fuel in the fuel path is not limited to the determination method based on the amount of the fuel leaking into the return passage 35 from the interior of the fuel injector 20. Instead, any method may be employed. For example, a determination method based on the amount of the fuel supplied to the fuel injector 20 or a determination method based on the amount of the fuel injected from the fuel injector 20 may be employed.

As long as the process for detecting the amount of generated heat of the fuel can be executed in a proper situation, the execution condition in the detection control process may be arbitrarily changed. Further, as long as the process for estimating the cetane number of the fuel can be executed in a proper situation, the execution condition in the estimation control process may be arbitrarily changed. For example, it is also possible to set a [Condition F] that "a predetermined time has elapsed after it is determined that the fuel has been supplied to the fuel tank 32" instead of the [Condition D]. According to the [Condition F], the replacement of the fuel in the fuel path can be determined as with the [Condition D] by setting a relatively short time as the predetermined time. On the other hand, a possibility that the property of the fuel in the fuel tank 32 has changed with the passage of time after the fuel supply can be determined through the [Condition F] and the process for estimating the cetane number of the fuel can be executed based on that determination. Further, it is also possible to set a [Condition G] that "an operation has been performed to stop the operation of the diesel engine 10". When the operation of the diesel engine 10 is stopped, the temperature thereof is sufficiently high in many cases. Thus, there is considered to be a high possibility that the operating state is stable as compared with the case where this temperature is low, and there is considered to be an environment where the detection of the amount of generated heat of the fuel and the estimation of the cetane number can be accurately executed based on the engine speed NE (specifically, engine speed fluctuation amount ΣΔNE). By setting the above [Condition G], the process for detecting the amount of generated heat of the fuel and the process for estimating the cetane number can be executed in such an environment. In addition, since the cetane number of the fuel used in starting the diesel engine 10 can be accurately estimated, starting performance of the diesel engine 10 can be improved. That the [Condition G] is satisfied can be determined when a driving switch is operated by a driver to stop the operation of the diesel engine 10.

Instead of providing the fuel sensor 41, which has functions of a pressure sensor and a temperature sensor, a pressure sensor and a temperature sensor may be separately provided. A mode of attaching the pressure sensor in this configuration is not limited to a mode in which the pressure sensor is directly attached to the fuel injector 20 and may be arbitrarily changed as long as a pressure that is an index of the fuel pressure inside the fuel injector 20 (specifically, in the nozzle chamber 25), i.e. a fuel pressure that changes with a change of the fuel pressure inside the fuel injector 20 can be properly detected. Specifically, the pressure sensor may be mounted in the branch passage 31*a* or the common rail 34. Further, a mode of attaching the temperature sensor in the above configuration is not limited to the mode in which the temperature sensor is directly attached to the fuel injector 20 and can be arbitrarily changed as long as the temperature of the fuel actually injected from the fuel injector 20 can be properly detected. Specifically, the temperature sensor may be mounted in the branch passage 31*a* or the common rail 34.

It is also possible to employ a fuel injector of a type driven by an electromagnetic actuator including, for example, a solenoid coil instead of the fuel injector 20 of the type driven by the piezoelectric actuator 29.

The present invention may be applied not only to diesel engines including four cylinders, also to single-cylinder diesel engines, diesel engines including two cylinders, those including three cylinders or those including five or more cylinders.

DESCRIPTION OF THE REFERENCE NUMERALS

1 . . . vehicle, 2 . . . clutch mechanism, 3 manual transmission, 4 . . . wheel, 10 . . . diesel engine, 11 . . . cylinder,

11*a* . . . combustion chamber, 12 . . . intake passage, 13 . . . piston, 14 . . . crankshaft, 15 . . . exhaust passage, 16 . . . supercharger, 17 . . . compressor, 18 . . . turbine, 20 . . . fuel injector, 21 . . . housing, 22 . . . needle valve, 23 . . . injection hole, 24 . . . spring, 25 . . . nozzle chamber, 26 . . . pressure chamber, 27 . . . introducing passage, 28 . . . communication passage, 29 . . . piezoelectric actuator, 29*a* . . . valve body, 30 . . . discharge passage, 31*a* . . . branch passage, 31*b* . . . supply passage, 32 . . . fuel tank, 33 . . . fuel pump, 34 . . . common rail, 35 . . . return passage, 40 . . . electronic control unit, 41 . . . fuel sensor, 42 . . . supercharging pressure sensor, 43 . . . crank sensor, 44 . . . water temperature sensor, 45 . . . reserve amount sensor, 46 . . . accelerator operation amount sensor, 47 . . . vehicle speed sensor, 48 . . . clutch switch

The invention claimed is:

1. A cetane number estimation device that executes fuel injection by a predetermined injection amount to estimate a cetane number of fuel to be combusted in a diesel engine, and estimates the cetane number based on a first index value of output torque of the diesel engine that is generated by execution of the fuel injection, wherein the device is configured to detect an index value of an amount of heat generated by combustion of the fuel by executing fuel injection by a predetermined injection amount to detect the amount of generated heat of the fuel, computing a second index value of output torque of the diesel engine that is generated by execution of the fuel injection, and setting the computed second index value as the index value of the amount of generated heat, and when estimating the cetane number based on the first index value, estimate the cetane number by referring to the index value of the amount of generated heat in addition to the first index value.

2. The cetane number estimation device according to claim 1, wherein the device is configured to store in advance a relationship between an estimated value of the cetane number and the first index value of the output torque, correct the relationship based on the index value of the amount of generated heat, and compute the estimated value of the cetane number based on the corrected relationship and the first index value of the output torque.

3. The cetane number estimation device according to claim 1, wherein the device is configured to store in advance a relationship between an estimated value of the cetane number and the first index value of the output torque, correct the first index value based on the index value of the amount of generated heat, and compute the estimated value of the cetane number based on the corrected first index value and the relationship.

4. The cetane number estimation device according to claim 1, wherein the device is configured to execute fuel injection for estimating the cetane number based on an injection amount that has been corrected in accordance with the index value of the amount of generated heat, and estimate the cetane number based on the first index value of the output torque that has been computed at the execution of the fuel injection.

5. The cetane number estimation device according to claim 1, wherein the device is configured to execute, based on a target injection amount, fuel injection for detecting the amount of generated heat, the device further comprising a pressure sensor that detects a fuel pressure that is an index of fuel pressure inside a fuel injector, wherein the device is configured to correct the target injection amount based on a fluctuating waveform of fuel pressure detected by the pressure sensor at fuel injection.

6. The cetane number estimation device according to claim 5, wherein the device is configured to compute an actual operating characteristic of the fuel injector based on the fluctuating waveform of the detected fuel pressure, and correct the target injection amount based on a difference between the computed actual operating characteristic and a predetermined basic operating characteristic.

7. The cetane number estimation device according to claim 5, wherein the pressure sensor is attached to the fuel injector.

8. The cetane number estimation device according claim 1, wherein the device is configured to execute, based on a target injection amount, fuel injection for detecting the amount of generated heat, detect a temperature of the fuel using a temperature sensor, and correct the target injection amount based on the detected fuel temperature.

9. The cetane number estimation device according to claim 8, wherein the device is configured to perform the detection of the fuel temperature using the temperature sensor immediately before the execution of the fuel injection for detecting the amount of generated heat.

10. The cetane number estimation device according to claim 1, wherein the device is configured to execute, based on a target fuel injection amount, fuel injection for estimating the cetane number, the device further comprising a pressure sensor that detects a fuel pressure that is an index of fuel pressure inside a fuel injector, and wherein the device is configured to correct the target fuel injection amount based on a fluctuating waveform of fuel pressure detected by the pressure sensor at fuel injection.

11. The cetane number estimation device according to claim 10, wherein the device is configured to compute an actual operating characteristic of the fuel injector based on the fluctuating waveform of the detected fuel pressure, and correct the target fuel injection amount based on a difference between the computed actual operating characteristic and a predetermined basic operating characteristic.

12. The cetane number estimation device according to claim 10, wherein the pressure sensor is attached to the fuel injector.

13. The cetane number estimation device according to claim 1, wherein the device is configured to execute, based on a target fuel injection amount, fuel injection for estimating the cetane number, detect a temperature of the fuel using a temperature sensor, and correct the target fuel injection amount based on the detected fuel temperature.

14. The cetane number estimation device according to claim 13, wherein the device is configured to perform the detection of the fuel temperature using the temperature sensor immediately before the execution of the fuel injection for estimating the cetane number.

* * * * *